US009752344B2

(12) United States Patent
Magargee

(10) Patent No.: US 9,752,344 B2
(45) Date of Patent: Sep. 5, 2017

(54) LIGHT POLE ASSEMBLIES, METHODS, AND DEVICES

(71) Applicant: Paul L. Magargee, Yorba Linda, CA (US)

(72) Inventor: Paul L. Magargee, Yorba Linda, CA (US)

( * ) Notice: Subject to any disclaimer, the term of this patent is extended or adjusted under 35 U.S.C. 154(b) by 339 days.

(21) Appl. No.: 14/663,391

(22) Filed: Mar. 19, 2015

(65) Prior Publication Data

US 2015/0267904 A1 Sep. 24, 2015

Related U.S. Application Data

(60) Provisional application No. 62/096,299, filed on Dec. 23, 2014, provisional application No. 61/968,002, filed on Mar. 20, 2014.

(51) Int. Cl.

| | |
|---|---|
| ***F21S 8/00*** | (2006.01) |
| ***E04H 12/22*** | (2006.01) |
| ***E04H 12/00*** | (2006.01) |

(52) U.S. Cl.

CPC ..... *E04H 12/2292* (2013.01); *E04H 12/003* (2013.01); *E04H 12/2238* (2013.01); *E04H 12/2269* (2013.01)

(58) Field of Classification Search

CPC ..... E04H 12/2292; E04H 12/003

See application file for complete search history.

(56) References Cited

U.S. PATENT DOCUMENTS

| | | | |
|---|---|---|---|
| 1,532,734 | A | 4/1925 | Dean |
| 2,547,789 | A | 4/1951 | Skeel |
| 2,883,849 | A | 4/1959 | Lorenzo |
| 2,528,691 | A | 9/1970 | Matich, Jr. |
| 3,528,691 | A | 9/1970 | Matich, Jr. |
| 4,059,934 | A | 11/1977 | Hayamizu |
| 4,133,154 | A | 1/1979 | Ruzicka |
| 4,706,437 | A | 11/1987 | Boecker, Jr. |
| 4,779,389 | A | 10/1988 | Landers |
| 4,824,303 | A | 4/1989 | Dinger |
| 4,987,718 | A | 1/1991 | Knight |
| 5,029,820 | A | 7/1991 | Katz |
| 5,369,925 | A | 12/1994 | Vargo |
| 5,832,675 | A | 11/1998 | Zuares |
| 6,079,165 | A | 6/2000 | Bingel, III et al. |

(Continued)

*Primary Examiner* — Evan Dzierzynski

(74) *Attorney, Agent, or Firm* — Knobbe Martens Olson & Bear, LLP

(57) ABSTRACT

A light pole repair/reinforcement assembly can include a reinforcement member having a reinforcement sleeve and reinforcement base plate configured to fit around a damaged light pole. The reinforcement sleeve can be used to bridge a damaged portion of the light pole to repair the pole without removing all or a portion of the pole. A modular pole assembly can include a pole base configured to mate with the pole portion via one or more wedge bolts, with or without welding. The modular pole assembly can include a cap configured to mate with an upper end of the pole portion. Locking hand hole covers, blind bolts, and/or base covers, as described herein, can be used in combination with the light pole repair assembly and/or with the modular pole assembly. In some cases, the locking hand hole covers, blind bolts, and/or base covers can in other applications.

18 Claims, 32 Drawing Sheets

(56) References Cited

U.S. PATENT DOCUMENTS

| | | | | |
|---|---|---|---|---|
| 6,176,062 | B1 * | 1/2001 | Fayle | E01F 15/0469 405/216 |
| 6,240,689 | B1 | 6/2001 | Haddad et al. | |
| 6,303,863 | B1 | 10/2001 | Raasch | |
| 6,578,393 | B2 | 6/2003 | Yarborought | |
| 6,833,505 | B1 | 12/2004 | Macchietto | |
| 6,886,296 | B1 * | 5/2005 | John | E04H 12/2292 248/519 |
| D520,145 | S | 5/2006 | Boyd | |
| 7,168,673 | B1 | 1/2007 | Piemonte et al. | |
| 7,197,806 | B2 | 4/2007 | Boudreaux et al. | |
| 7,415,808 | B2 | 8/2008 | Bingel, III et al. | |
| 7,490,964 | B2 | 2/2009 | Haddad et al. | |
| 7,560,642 | B2 | 7/2009 | Ygnelzi et al. | |
| 7,884,283 | B1 | 2/2011 | Ousley | |
| 8,562,243 | B2 | 10/2013 | Dizdarevic | |
| 8,661,767 | B2 | 3/2014 | Svendsen | |
| 8,689,590 | B2 | 4/2014 | Madruga et al. | |
| 2003/0163960 | A1 | 9/2003 | Hadden | |
| 2005/0103065 | A1 | 5/2005 | Dennis | |
| 2005/0244607 | A1 | 11/2005 | Irvin et al. | |
| 2007/0116515 | A1 | 5/2007 | Woytowich et al. | |
| 2008/0000192 | A1 | 1/2008 | McGlinch | |
| 2009/0188207 | A1 | 7/2009 | Gordin et al. | |
| 2009/0320396 | A1 * | 12/2009 | Knudsen | E04H 12/2269 52/297 |
| 2014/0083146 | A1 | 3/2014 | Ousley | |
| 2015/0013267 | A1 | 1/2015 | Huncovsky | |

* cited by examiner

LIGHT POLE ASSEMBLIES, METHODS, AND DEVICES

RELATED APPLICATIONS

The present application claims priority under 35 U.S.C. §119(e) to U.S. Provisional Patent Application Ser. No. 61/968,002, filed Mar. 20, 2014 and U.S. Provisional Patent Application Ser. No. 62/096,299, filed Dec. 23, 2014. The above-referenced applications are hereby incorporated by reference herein in their entirety.

TECHNICAL FIELD

Certain embodiments discussed herein relate to light pole assemblies, light pole repair assemblies, and light pole security assemblies.

DISCUSSION OF THE RELATED ART

Light poles are often installed in outdoor environments and are thus subject to environmental phenomena such as rain, snow, sunlight, and other damaging circumstances. For example, the lower portions of light poles are often subject to rust damage. Replacing light poles can be costly and inconvenient. Contractors are often forced to stock replacement light poles of various geometries and/or pay for shipment of replacement light poles.

In some instances, copper wire theft is a high risk during and after pole installation. The wiring is often accessed through unprotected or under-protected hand-holes near the base of the light poles. Manufacturers and contracts have attempted to reduce the occurrences of wire theft by putting locked covers on hand-holes. These covers, however, are often susceptible to tampering.

SUMMARY

A light pole repair assembly for repairing or reinforcing a light pole can include a reinforcement member. The reinforcement member can include a reinforcement base having a slot configured to receive at least a portion of the light pole. In some embodiments, the stabilizing base includes a plurality of apertures configured to receive one or more fasteners. The reinforcement member can include a reinforcement sleeve. The reinforcement sleeve can have a first sidewall connected to the reinforcement base and extending upward from the reinforcement base. In some embodiments, reinforcement sleeve has a second sidewall connected to and extending upward from the reinforcement base and connected to the first sidewall. In some cases, reinforcement sleeve includes a third sidewall connected to and extending upward from the reinforcement base and connected to the first sidewall. In some embodiments, the repair assembly includes a plurality of spacers connected to the reinforcement base and to anchor bolts extending upward from a base of the light pole when the slot of the reinforcement base receives at least a portion of the light pole. The plurality of spacers can be positioned between the reinforcement base and the base of the light pole and can be configured to space the reinforcement base above the base of the light pole. In some embodiments, the first, second, and third sidewalls of the reinforcement sleeve are positioned on three sides of a pole portion of the light pole when the slot of the reinforcement base receives at least a portion of the light pole. In some embodiments, the reinforcement sleeve is affixed to the pole portion of the light pole when the slot of the reinforcement base receives at least a portion of the light pole.

In some cases, the light pole repair assembly includes a plurality of all-thread bolts inserted through a plurality of apertures in the reinforcement base and threadedly engaged with at least a portion of the each of the plurality of spacers. In some embodiments, the first, second, and third sidewalls of the reinforcement sleeve extend below and above a hand hole of the light pole when the slot of the reinforcement base receives at least a portion of the light pole. In some cases, the reinforcement base has a generally square perimeter. In some embodiments, the reinforcement base has a generally circular shape.

A hand hole cover for a light pole hand hole can include a cover frame. The cover frame can have a perimeter sized and shaped to surround the hand hole. The cover frame can include a back side configured to abut an outer wall of the light pole. In some embodiments, the cover frame includes a front side spaced from the outer wall of the light pole. The cover frame can include a wall extending between the front side and the back side. In some embodiments, the cover frame includes a cover aperture extending through the wall and configured to receive a body of a lock. The cover can include a mating plate. The mating plate can have a front side and a back side. In some embodiments, the mating plate is positioned between the front side and the back side of the cover frame within the perimeter of the cover frame. The mating plate can be connected to the cover frame. In some embodiments, the mating plate includes a loop aperture, a first lock aperture, and/or a second lock aperture. The hand hole cover can include a backing bar. The backing bar can be configured to fit within the light pole. In some embodiments, the backing bar has a first end, a second end, and a length between the first end and the second end. The length of the backing bar can be greater than a height of the hand hole and/or greater than a width of the hand hole. In some embodiments, the hand hole cover includes a first fastener configured to pass through the first lock aperture. The first fastener can be configured to connect to the backing bar at a first position along the length of the backing bar. In some embodiments, the first fastener is configured to draw the backing bar toward the mating plate in response to user input. The hand hole cover can include a second fastener. The second fastener can be configured to pass through the second lock aperture, configured to connect to the backing bar at a second position along the length of the backing bar, and/or configured to draw the backing bar toward the mating plate in response to user input. In some embodiments, the hand hole cover includes a cover plate. The cover plate can include a front surface, a back surface, and a lock loop extending from the back surface of the cover plate. In some embodiments, the lock loop is configured to fit through the loop aperture from the front side of the mating plate. The lock loop can be configured to receive a shank of the lock. In some embodiments, the backing bar is configured to secure the cover frame against the outer wall of the light pole in response to user input to draw the backing bar toward the mating plate when the backing bar is positioned within the light pole. In some embodiments, the cover plate is configured to inhibit access to the lock loop and mating plate when the lock loop is inserted through the loop aperture, the lock shank is inserted through the lock loop, the lock is in a locked configuration, and the cover frame is secured against the outer wall of the light pole.

In some embodiments, the first and second fasteners are bolts. In some cases, the backing bar comprises a center portion having a first height as measured perpendicular to the length of the backing bar toward the mating plate, a first outer portion between the first end of the backing bar and the center portion and having a second height as measured perpendicular to the length of the backing bar toward the mating plate, and wherein the second height is less than the first height. In some embodiments, the mating plate comprises one or more viewing apertures configured to permit a user to view a position of the backing bar during installation of the hand hold cover. In some cases, the back side of the cover frame is planar when the hand hole cover is installed on a light pole having a rectangular cross-section. In some embodiments, the back side of the cover frame has a concave shape when the hand hole cover is installed on a light pole having a circular or oval-shaped cross-section.

A modular light pole assembly can include a pole base. The pole base can include a pole base plate. The pole base plate can have a plurality of apertures configured to receive one or more fasteners. In some embodiments, the pole base includes a hollow pole base sleeve. The base sleeve can be connected to and extend upward from the pole base plate. In some embodiments, the pole base sleeve has a cross-sectional shape parallel to the pole base plate. In some embodiments, the pole base sleeve includes at least one sidewall. The at least one side wall can include an inner surface, an outer surface, and/or a hand hole through the at least one sidewall. In some embodiments, the modular light pole assembly includes at least one wedge bolt. The at least one wedge bolt can be configured to fit at least partially within a space between the inner surface of the at least one sidewall of the pole base sleeve and an outer surface of a hollow pole having a cross-sectional shape different from the cross-sectional shape of the hollow pole base sleeve. The at least one wedge bolt can include a wedge sleeve assembly. The wedge sleeve assembly can include first end, a second end, and a length extending between the first end and the second end. In some embodiments, the wedge sleeve assembly has a plurality of wedge portions unconnected to each other wedge portion. In some cases, each of the plurality of wedge portions have an internal channel through at least a portion of a length of each wedge portion. In some embodiments, the at least one wedge bolt includes an elongate member configured to extend through at least a portion of each of the internal channels of the plurality of wedge portions. The elongate member can be configured to receive user input to shorten the length of the wedge sleeve. In some embodiments, at least two of the wedge portions have contact ends that are configured to contact each other when the length of the wedge sleeve is shortened. In some cases, each of the contact ends lie on parallel planes. The parallel planes of the contact ends can be offset from the length of the wedge sleeve by a first angle between 0° and 90°. In some cases, when the length of the wedge sleeve is shortened, the at least one of the wedge portions is configured move in a direction lateral to the length of the wedge sleeve to mate the hollow pole to the hollow pole base sleeve.

In some embodiments, the cross-sectional shape of the hollow pole base sleeve is generally rectangular. In some cases, the at least one wedge bolt is configured to fit at least partially within a space between the inner surface of the at least one sidewall and a hollow pole having a round cross-sectional shape.

In some cases, the modular light pole assembly includes a cap. The cap can include a hollow mating portion having a first cross-sectional shape and a longitudinal axis. In some cases, the cap includes a collar portion connected to the mating portion and having a second cross-sectional shape. The cap can include a hollow coupling portion connected to the collar portion and extending away from the mating portion. The hollow coupling portion can have a third cross-sectional shape. In some embodiments, the cap includes at least one wedge member. Each wedge member can include a first portion connected to at least one of the collar portion and the hollow mating portion. The first portion can have a first end and a second end between the first end and the collar portion. The first portion can include a first connector channel extending through the first and second ends of the first portion. The first end of the first portion can have a first sloped surface lying on a plane offset from the longitudinal axis of the hollow mating portion by an angle between 0° and 90°. In some embodiments, each wedge member includes a second portion having a first end, a second end between the first end and the first end of the first portion, and a second connector channel extending through the first and second ends of the second portion. The second end of the second portion can have a second sloped surface lying on a plane parallel to the plane of the first sloped surface of the first end of the first portion. In some embodiments, each wedge member includes an extended member extending through the first and second ends of the first portion and the second end of the second portion. The extended member can be configured to receive user input to move the second portion toward the first portion. In some embodiments, the second portion of each wedge member is configured to move laterally outward with respect to the longitudinal axis of the hollow mating portion when the second portion is moved toward the first portion of each wedge member.

In some embodiments, the hollow pole base sleeve includes one or more internal flanges configured to limit downward movement of the hollow pole within the hollow pole base sleeve. In some embodiments, the modular light pole assembly comprises a security cap. The security cap can include a cap portion. In some embodiments, the security cap includes a coupling portion connected to the cap portion and extending downward from the cap portion. In some cases, the hollow pole base sleeve includes one or more internal flanges. In some embodiments, the coupling portion is configured to releasably connect to one or more of the one or more internal flanges. In some cases, the cap portion is sized and shaped to inhibit or prevent access to an interior of the hollow pole base from a top end of the hollow poll base past the cap portion. In some embodiments, the coupling portion includes a bolt extender connected to and extending downward from the cap portion, and a bolt connected to and extending downward from the bolt extender.

A method of constructing a modular light pole can include securing a base plate of a light pole base to a light pole installation site. The method can include inserting a lower portion of a hollow pole into a top end of the light pole base. In some cases, the method includes inserting one or more wedge bolts into a space between an inner wall of the light pole base and an outer wall of the hollow pole. The method can include tightening the one or more wedge bolts to secure the hollow pole to the light pole base. In some embodiments, the method includes securing a locking hand hole cover to a hand hole in a sidewall of the light pole base to inhibit or prevent access to an interior of the light pole base through the hand hole. The method can include installing a security cap onto the light pole base to inhibit or prevent access into an interior of the light pole base from the top end of the light pole base past the security cap. In some embodiments, the method includes using the base plate as a template to set one or more anchor bolts in a concrete anchor base. The method can include inserting a mating portion of a cap into a top end of the hollow pole, and tightening one or more wedge members on the cap to secure the cap to the top end of the hollow pole. In some embodiments, the method includes connecting the base plate to one or more anchor bolts using locking nuts. In some cases, the method includes connecting the base plate to one or more anchor bolts using propeller locks.

According to some variants, a light pole base cover comprises an upper end, a lower end opposite the upper end, a first side adjacent the upper end and the lower end, and a second side adjacent the upper end and the lower end and opposite the first side. The cover can include one or more mating structures on the first side and on the second side. In some cases, the cover includes a front surface. The front surface can be bounded by the upper end, the lower end, the first side, and the second side. The cover can include a first size marking on the front surface. In some embodiments, the cover includes a second size marking on the front surface. In some embodiments, the light pole base cover is configured to transition between a flat configuration and a frustoconical configuration having an upper aperture and a lower aperture. In some cases, the first size marking on the front surface corresponds to an upper aperture of the frustoconical configuration having a first cross-sectional size when all portions of the light pole base cover between the first size marking and the upper end are removed. In some embodiments, the second size marking on the front surface corresponds to an upper aperture of the frustoconical configuration having a second cross-sectional size different from the first cross-sectional size when all portions of the light pole base cover between the second size marking and the upper end are removed.

In some embodiments, the front surface comprises a first label corresponding to the first size marking, the first label identifying the first cross-sectional size. In some cases, the front surface comprises a second label corresponding to the second size marking, the second label identifying the second cross-sectional size. In some embodiments, the one or more mating structures comprise one or more tabs and one or more slits configured to receive the one or more tabs. In some cases, the upper aperture is sized to match an outer surface of a pole portion of a light pole. In some embodiments, the lower aperture is sized to match an outer surface of a footing or other installation base of a light pole.

A light pole repair kit for repairing or reinforcing a light pole can include a reinforcement member comprising a reinforcement base having a slot configured to receive at least a portion of the light pole, the reinforcement base including a plurality of apertures configured to receive one or more fasteners; and a reinforcement sleeve having a first sidewall connected to the reinforcement base and extending upward from the reinforcement base, a second sidewall connected to and extending upward from the reinforcement base and connected to the first sidewall, and a third sidewall connected to and extending upward from the reinforcement base and connected to the first sidewall. The first, second, and third sidewalls of the reinforcement sleeve can be positioned on three sides of a pole portion of a light pole when the slot of the reinforcement base receives at least a portion of a light pole, and wherein the reinforcement sleeve can be affixed to a pole portion of a light pole when the slot of the reinforcement base receives at least a portion of a light pole. The kit can include a plurality of spacers connected. The kit can include a plurality of all-thread bolts. In some cases, the first, second, and third sidewalls of the reinforcement sleeve extend below and above a hand hole of a light pole when the slot of the reinforcement base receives at least a portion of a light pole. In some cases, the reinforcement base has a generally square perimeter. In some cases, the reinforcement base has a generally circular shape.

A hand hole cover kit for a light pole hand hole can include a cover frame having a perimeter sized and shaped to surround the hand hole, a back side configured to abut an outer wall of a light pole, a front side spaced from the outer wall of the light pole, a wall extending between the front side and the back side, and a cover aperture extending through the wall and configured to receive a body of a lock. The kit can include a mating plate having a front side and a back side, the mating plate comprising a loop aperture, a first lock aperture, and a second lock aperture. In some cases, the kit includes a backing bar configured to fit within a light pole, the backing bar having a first end, a second end, and a length between the first end and the second end, the length of the backing bar being greater than a height of the hand hole and greater than a width of the hand hole. The kit can include a first fastener and a second fastener. In some cases, the kit includes a cover plate having a front surface, a back surface, and a lock loop extending from the back surface of the cover plate, the lock loop configured to receive a shank of a lock. In some cases, the mating plate comprises one or more viewing apertures configured to permit a user to view a position of the backing bar during installation of the hand hold cover. In some cases, the back side of the cover frame is planar when the hand hole cover is installed on a light pole having a rectangular cross-section. In some cases, the back side of the cover frame has a concave shape when the hand hole cover is installed on a light pole having a circular or oval-shaped cross-section.

A modular light pole assembly kit can include a pole base having: a pole base plate having a plurality of apertures configured to receive one or more fasteners; and a hollow pole base sleeve connected to and extending upward from the pole base plate, pole base sleeve having a cross-sectional shape parallel to the pole base plate and at least one sidewall with an inner surface and an outer surface and a hand hole through the at least one sidewall. The kit can include at least one wedge bolt. The at least one wedge bolt can include a wedge sleeve assembly having first end, a second end, and a length extending between the first end and the second end, wedge sleeve assembly having a plurality of wedge portions unconnected to each other wedge portion, each of the plurality of wedge portions have an internal channel through at least a portion of a length of each wedge portion; and an elongate member configured to extend through at least a portion of each of the internal channels of the plurality of wedge portions, the elongate member configured to receive user input to shorten the length of the wedge sleeve wherein at least two of the wedge portions have contact ends that are configured to contact each other when the length of the wedge sleeve is shortened, each of the contact ends lying on parallel planes, the parallel planes of the contact ends being offset from the length of the wedge sleeve by a first angle greater than 0° and less than 90°; and wherein, when the length of the wedge sleeve is shortened, the at least one of the wedge portions is configured move in a direction lateral to the length of the wedge sleeve. to mate a hollow pole to the hollow pole base sleeve. In some cases, the kit includes a cap having: a hollow mating portion having a first cross-sectional shape and a longitudinal axis; a collar portion connected to the mating portion and having a second cross-sectional shape; and a hollow coupling portion connected to the collar portion and extending away from the mating portion, the hollow coupling portion having a third cross-sectional shape. The kit can include at least one wedge member having a first portion connected to at least one of the collar portion and the hollow mating portion, the first portion having a first end, a second end between the first end and the collar portion, and a first connector channel extending through the first and second ends of the first portion, the first end of the first portion having a first sloped surface lying on a plane offset from the longitudinal axis of the hollow mating portion by an angle greater than 0° and less than 90°; a second portion having a first end, a second end between the first end and the first end of the first portion, and a second connector channel extending through the first and second ends of the second portion, the second end of the second portion having a second sloped surface lying on a plane parallel to the plane of the first sloped surface of the first end of the first portion; and an extended member extending through the first and second ends of the first portion and the second end of the second portion. In some cases, the second portion of each wedge member is configured to move laterally outward with respect to the longitudinal axis of the hollow mating portion when the second portion is moved toward the first portion of each wedge member. In some cases, the hollow pole base sleeve includes one or more internal flanges. The kit can include a security cap having: a cap portion; and a coupling portion connected to the cap portion and extending downward from the cap portion. In some cases, the hollow pole base sleeve includes one or more internal flanges. In some cases, the coupling portion includes a bolt extender connected to and extending downward from the cap portion, and a bolt connected to and extending downward from the bolt extender.

BRIEF DESCRIPTION OF THE DRAWINGS

The present disclosure described with reference to the accompanying drawings, in which like reference characters reference like elements, and wherein.

DETAILED DESCRIPTION

Light Pole Reinforcement/Repair Assembly

Light poles are often exposed to environmental phenomena such as rain, snow, wind, sunlight, and other phenomena that can lead to damage to portions of the light pole. The bases and other lower portions of light poles can be particularly susceptible to damage from moisture, snow, salt, and other damaging materials. Replacement of the entire light pole can be an expensive and time-intensive endeavor. Thus, it may be desirable to repair a damaged light pole without replacing the entire pole.

Figure 1:
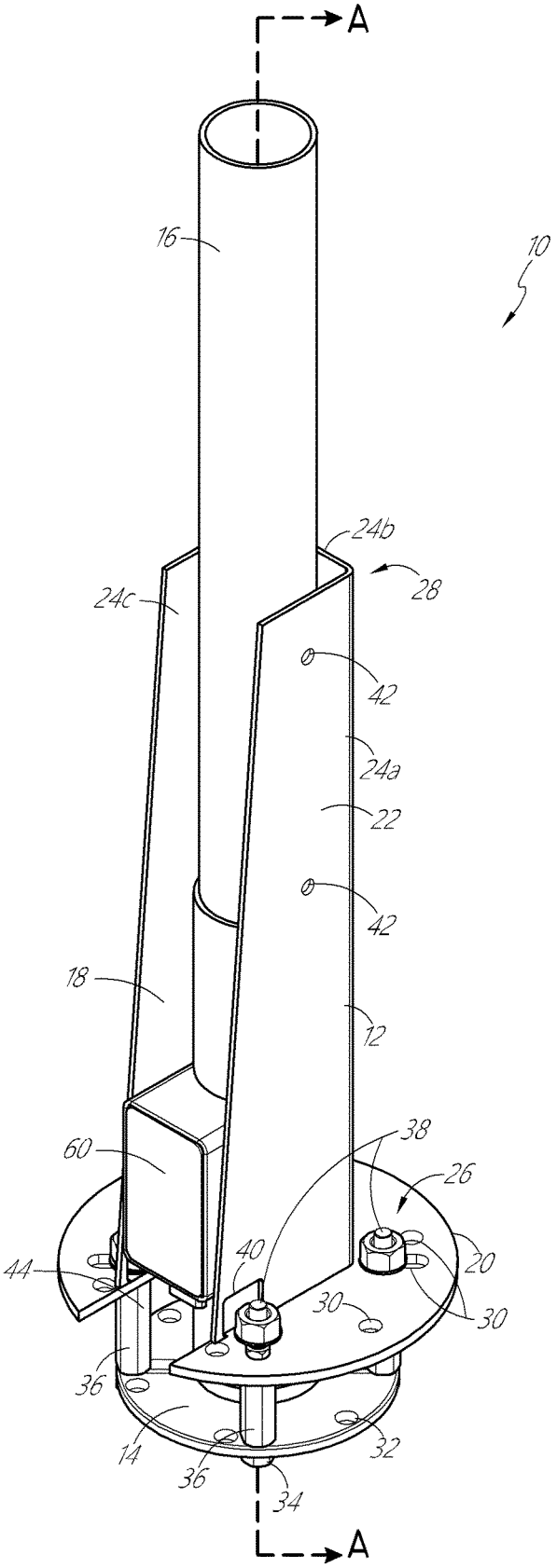
FIG. 1 is a perspective view of an embodiment of a light pole repair assembly.

FIG. 1 illustrates a light pole reinforcement/repair assembly 10 (hereinafter "repair assembly 10"). The repair assembly 10 can include a reinforcement member 12. In some embodiments, the reinforcement member 12, or some portion thereof, is constructed from steel, galvanized steel, and/or some other material suitable for bearing structural loads. The reinforcement member 12 can be configured to couple with the existing light pole needing repair. In some embodiments, the reinforcement member 12 can couple with a base plate 14 of the light pole via welding, fasteners, and/or some other connection method or structure. The reinforcement member 12 can connect to a pole portion 16 of the existing pole via welding, fasteners, and/or some other connection method or structure. In some embodiments, the reinforcement member 12 is configured to structurally bridge the damaged portion of the existing pole between the base plate 14 and a segment of the pole portion 16 above the damaged portion. Coupling between the reinforcement member 12 and the existing pole can, in some cases, be accomplished without uninstalling or otherwise moving the existing pole. In some embodiments, coupling between the reinforcement member 12 and the existing pole can be accomplished without blocking access to a hand hole 18 of the existing pole.

The reinforcement member 12 can include a reinforcement base plate 20. As illustrated, the reinforcement member 12 can include a reinforcement sleeve 22 connected to the base plate 20 (e.g., via welding, fasteners, or some other connection method or structure). The reinforcement sleeve 22 can extend upward from the base plate 20. The reinforcement sleeve 22 can have a first end 26 connected to the base plate 20 and a second end 28 spaced above the first end 26 of the reinforcement sleeve 22. A height (e.g., length) of the reinforcement sleeve 22 can be measured between the first and second ends 26, 28 of the reinforcement sleeve 22.

The reinforcement sleeve 22 can include a first sidewall 24*a* connected to the base plate 20. In some embodiments, the reinforcement sleeve 22 includes a second sidewall 24*b* connected to the base plate 20 and connected to the first sidewall 24*a*. The second sidewall 24*b* can be generally perpendicular (e.g., within ±10° of perpendicular) to the base plate 20 and to the first sidewall 24*a*. As illustrated in FIG. 1, the sleeve 22 can include a third sidewall 24*c* connected to the second sidewall 24*b* and to the base plate 20. The third sidewall 24*c* can be generally parallel (e.g., within ±10° of parallel) to the first sidewall 24*a*. In some embodiments, the third sidewall 24*c* is spaced from the first sidewall 24*a* by a distance 46 generally equal to (e.g., within 10%) or greater than an outer diameter 48 of the pole portion 16 of the existing pole (see FIG. 5).

Figure 2:
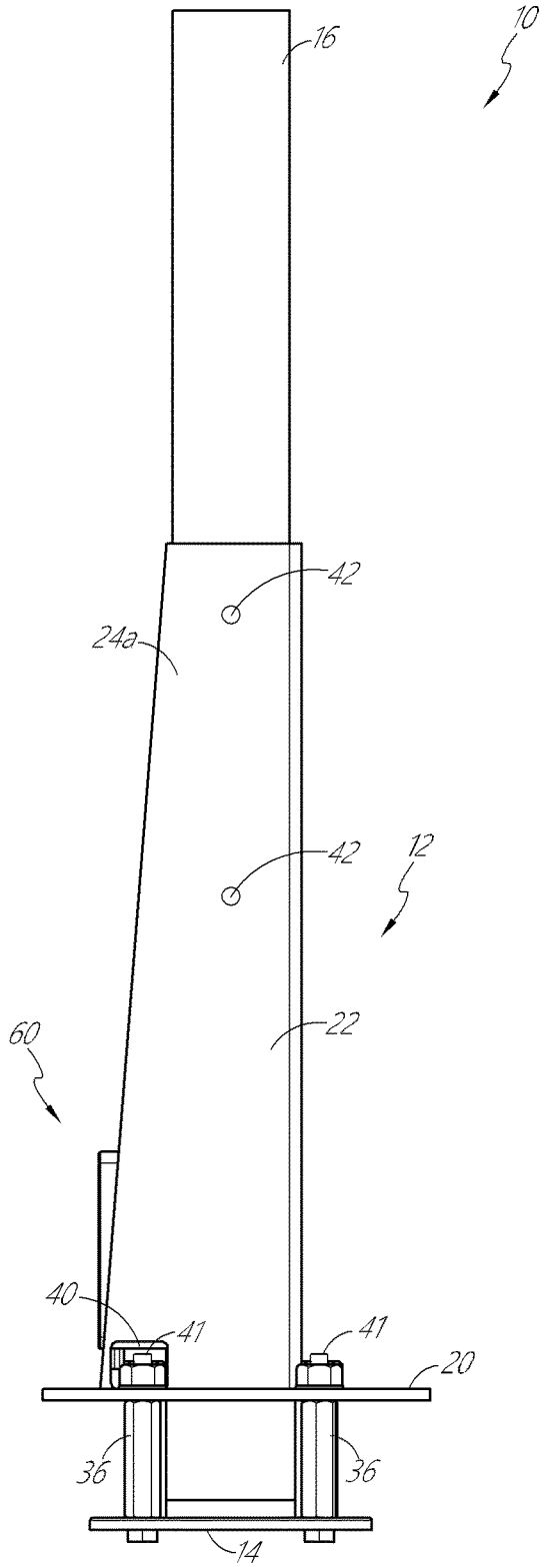
FIG. 2 is a right-side plan view of the light pole repair assembly of FIG. 1.
Figure 3:
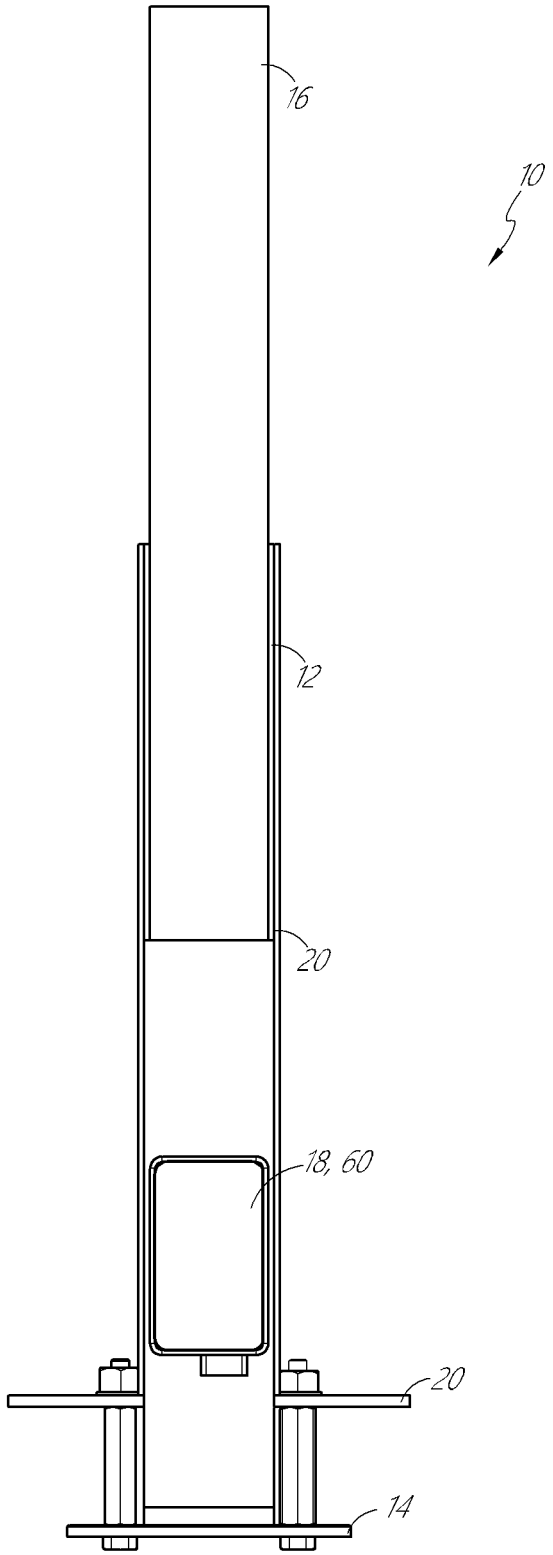
FIG. 3 is a front plan view of the light pole repair assembly of FIG. 1.

In some embodiments, as illustrated in FIGS. 1 and 2, the first, second, and/or third sidewalls 24*a*, 24*b*, 24*c* can have substantially equal widths at the second end 28 of the sleeve 22. For example, the widths of the sidewalls 24*a*, 24*b*, 24*c* can be substantially equal to the diameter/cross-sectional width of the pole 16 portion of the existing pole. In some embodiments, the first and third sidewalls 24*a*, 24*c* of the reinforcement sleeve 22 can be wider at the first end 26 of the sleeve 22 than at the second end 28 of the sleeve 22. The widths of the first and third sidewalls 24*a*, 24*c* of the reinforcement sleeve 22 can be widened at the first end 26 of the sleeve 22 to include a lower aperture 40 through each of the first and third walls 24*a*, 24*c*. The lower apertures 40 can be positioned to provide clearance for washers, nuts, or other fastening components connected to the base plate 20.

Figure 5:
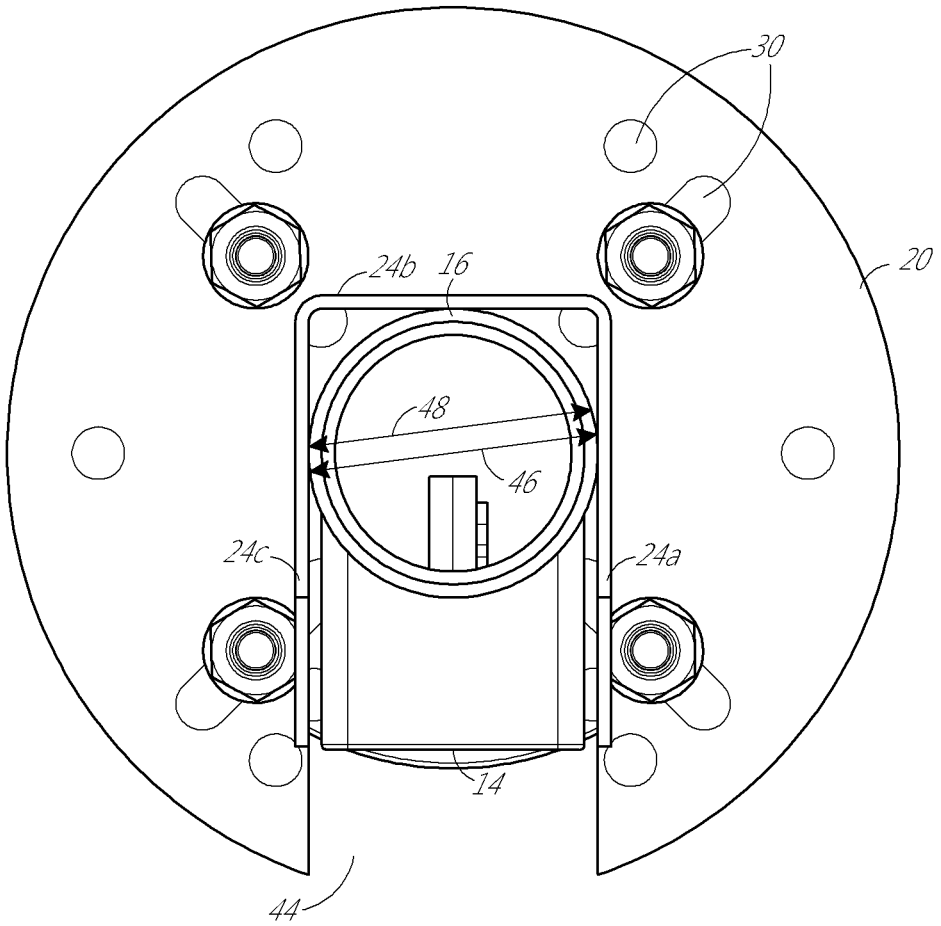
FIG. 5 is a top plan view of the light pole repair assembly of FIG. 1.

As illustrated in FIGS. 1 and 5, the base plate 20 can include a slot 44. The slot 44 can extend from a lateral edge of the base plate 20 to a central portion of the base plate 20. The slot 44 can be sized to permit lateral movement (e.g., lateral to a longitudinal axis of the existing pole) of the reinforcement member 12 with respect to the existing pole. For example, the reinforcement member 12 can be placed onto/around the existing pole via lateral movement of the reinforcement member 12 onto existing pole, wherein the existing pole fits through the slot 44 and between the first and third sidewalls 24*a*, 24*c* of the reinforcement sleeve portion 22. Coupling the reinforcement member 12 onto the existing pole in such a manner can facilitate coupling of the reinforcement member 12 onto the existing pole without removal of the existing pole from its installation location.

The reinforcement base plate 20 can include a plurality of holes 30. The holes 30 can be distributed and positioned on the base plate 20 and can align with one or more holes 32 or fasteners 34 of the existing light pole base 14. In some embodiments, the reinforcement base plate 20 can include holes 30 in more than one pattern to match more than one standard or custom hole distribution pattern on an existing light pole. The holes 30 can be distributed such that a single embodiment of a base plate 20 can be used in combination with a wide variety of bolt/hole patterns on existing light poles.

As illustrated in FIGS. 1-4, the repair assembly 10 can include a plurality of spacers 36. The spacers 36 can be configured to facilitate connection between the base plate 20 of the reinforcement member 12 and the base plate 14 of the existing pole. The spacers 36 can be, for example, sleeves having inner threading. In some embodiments, the spacers 36 have an outer cross-sectional shape (e.g., hexagon, pentagon, square, etc.) configured to facilitate user input (e.g., a wrench or other tool) to tighten the spacers 36 onto the anchor bolts (not shown) of the existing pole.

In some embodiments, all-thread bolts 38 are connected to the spacers 36 through an end of the spacers 36 opposite the anchor bolts. The all-thread bolts 38 can extend upward through one or more of the holes 30 of the reinforcement base plate 20. Nuts 41 or other fastening structures can be used to tighten the reinforcement base plate 20 onto the spacers 36 and all-thread bolts 38 to facilitate connection between the reinforcement base plate 20 and the base plate 14 of the existing pole. In some embodiments, the nuts 41 can be tamper resistant.

Figure 4:
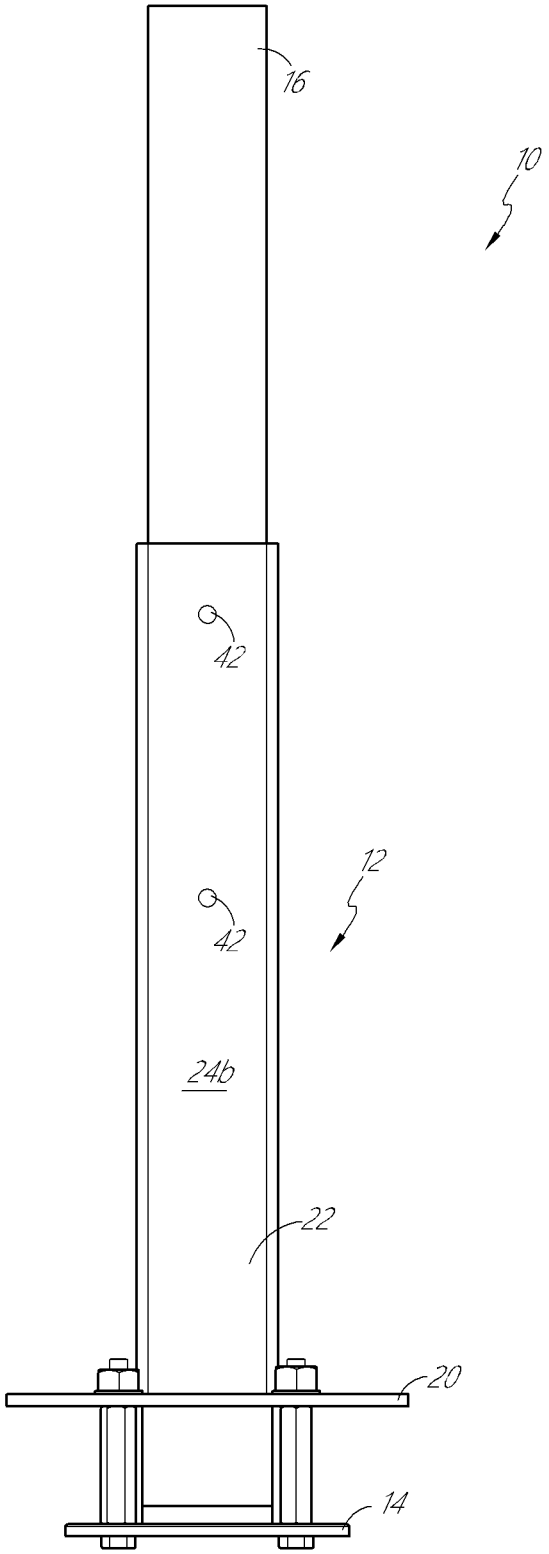
FIG. 4 is a rear plan view of the light pole repair assembly of FIG. 1.

As illustrated in FIGS. 1 and 4, the sidewalls 24*a*, 24*b*, 24*c* of the sleeve portion 22 can include one or more apertures 42. The apertures 42 can be sized and shaped to receive fasteners (e.g., self-locking fasteners, as described below). The fasteners (not shown) can connect the reinforcement sleeve portion 22 to the pole portion 16 of the existing pole in addition to or instead of other connection methods or structures (e.g., welding).

Figure 6:
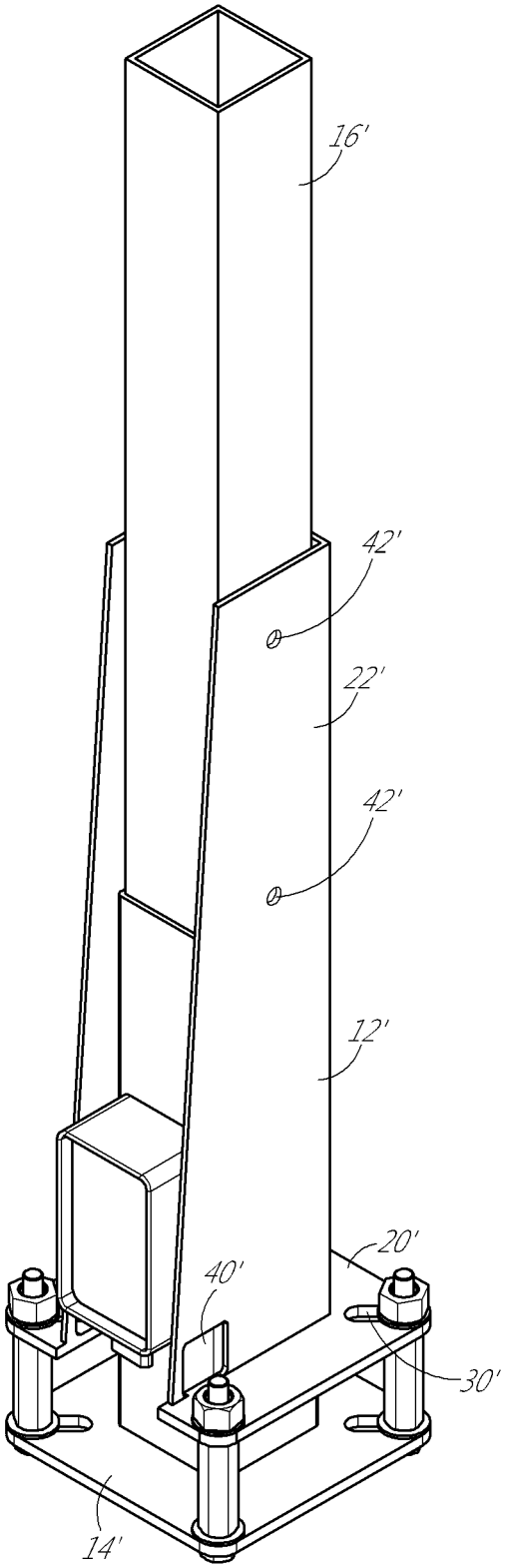
FIG. 6 is a perspective view of an embodiment of a light pole repair assembly at least partially connected to a square pole.
Figure 7:
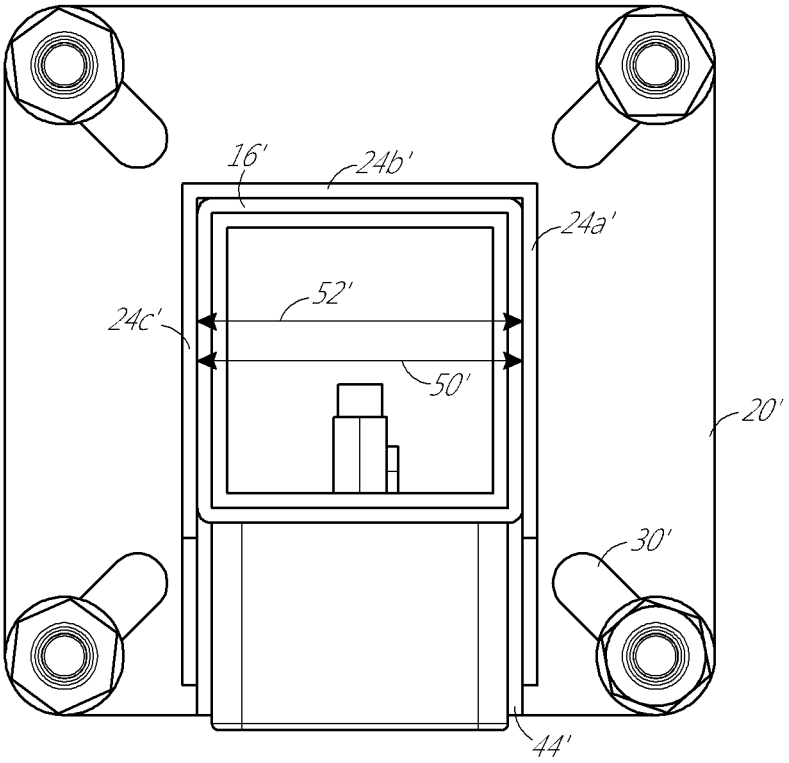
FIG. 7 is a top view of the light pole repair assembly of FIG. 6.
Figure 8:
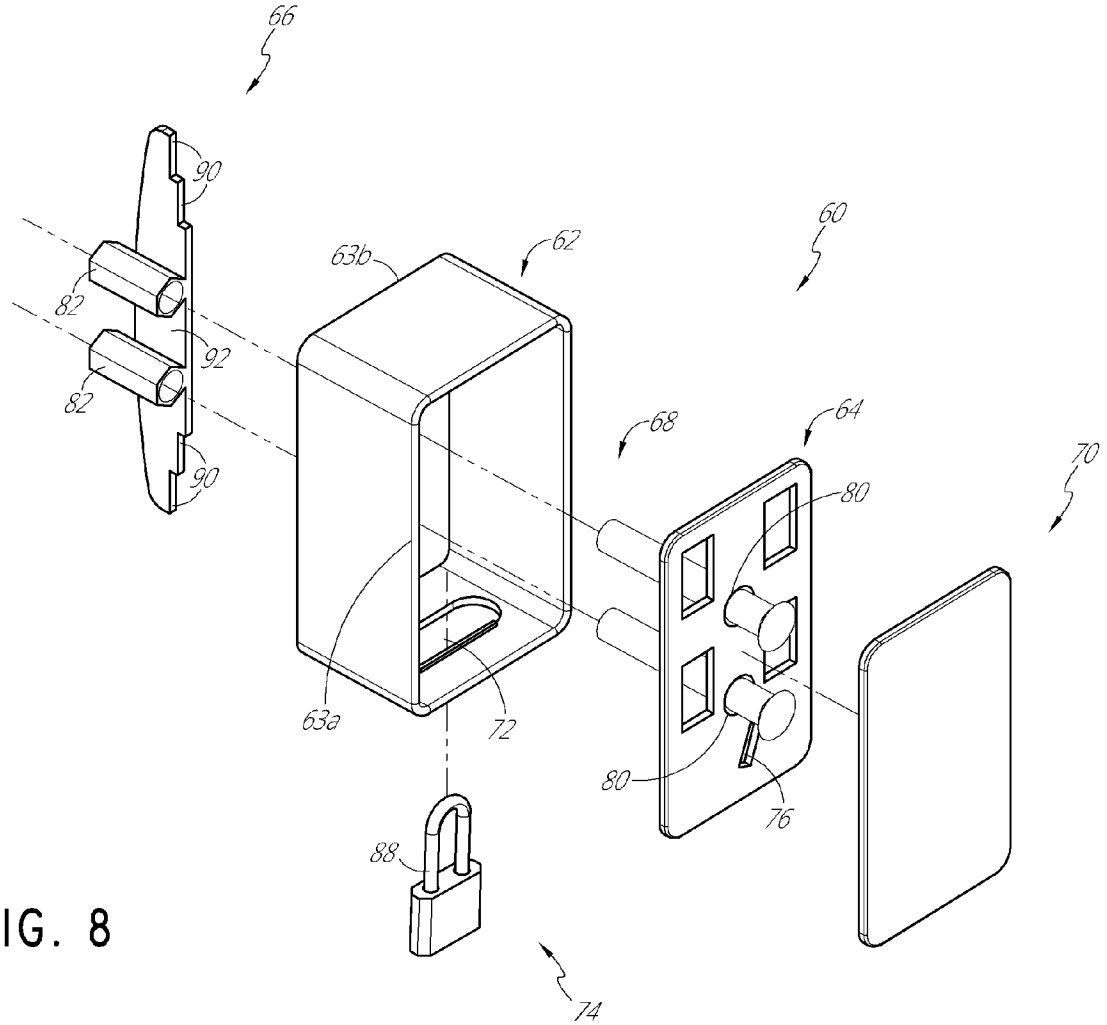
FIG. 8 is a front perspective exploded view of an embodiment of a locking hand hole cover assembly.
Figure 9:
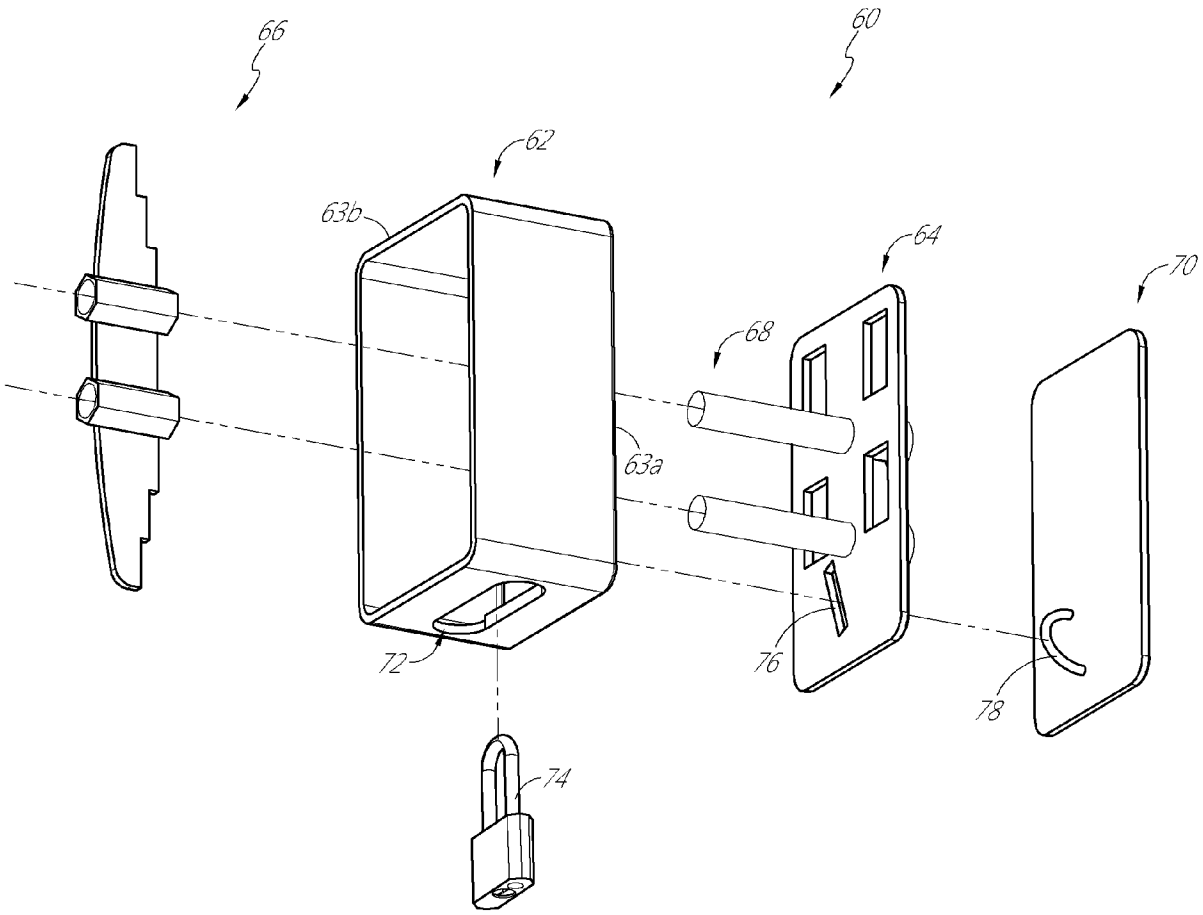
FIG. 9 is a rear perspective exploded view of an embodiment of the locking hand hole cover assembly of FIG. 8.

FIGS. 6 and 7 illustrate an embodiment of a reinforcement member 12' which has many features which are the same as, or similar to the features of reinforcement member 12 described above. Some numerical references to components in FIGS. 6 and 7 are the same as or similar to those previously described for the reinforcement member 12. It is to be understood that the components can be the same in function/structure or are similar in function/structure to the previously-described components of the reinforcement member 12.

The reinforcement member 12' of FIGS. 6 and 7 shows certain variations to the reinforcement member 12. For example, reinforcement member 12' can include a base plate 20' having a generally rectangular shape as compared to the generally circular shape of the base plate 20 of the reinforcement member 12.

FIGS. 6 and 7 illustrate that the reinforcement member 12' (and also the reinforcement member 12) can be coupled with an existing light pole having a rectangular (e.g., square) cross-section. For example, the holes 30/30' of the base plates 20/20' can be distributed to align with anchor bolts in a light pole installation having a rectangular base 14 or a circular base 14'.

The first and third walls 24*a*', 24*c*' of the sleeve portion 22' can be spaced from each other by a distance 50. The distance 50 can be approximately equal to the width 52 of the pole portion 16' of the existing pole illustrated in FIGS. 6 and 7. In some embodiments, the distance 46 between the first and third walls 24*a*, 24*c* of the sleeve portion 22 can be approximately equal to the width 52 of the pole portion 16' of the existing pole illustrated in FIGS. 6 and 7.

A method of reinforcing a light pole can include identifying a damaged portion of the existing pole. As discussed above, the damaged portion is often at or near the base 14 and/or in a lower segment of the pole portion 16 of the existing pole. The method can include selecting a reinforcement member 12 that is tall enough (e.g., has a sleeve portion 22 of sufficient height) to span the damaged portion of the existing pole.

In some embodiments, existing nuts or other fastener structures are removed from the anchor bolts of the existing pole. A plurality of spacers 36 can be connected to the anchor bolts. In some embodiments, all-thread bolts 38 are connected to the spacers 36.

The selected reinforcement member 12 can moved laterally onto the existing pole in the manner described above. The base plate 20 of the reinforcement member 12 can be positioned on the spacers 36. In some embodiments, the apertures 30 of the base plate 20 are aligned with the spacers 36 to receive the all-thread bolts 38 there through. One or more nuts 41 can be tightened onto the all-thread bolts 38 to secure the base plate 20 of the reinforcement member 12 to the anchor bolts. In some embodiments, the apertures 30 of the base plate 20 are aligned with the spacers 36 and bolts (not shown) are inserted through the apertures 30 from above the base plate 20 and into the spacers 36. The bolts can be tightened to secure the base plate 20 to the anchor bolts via the spacers 36.

The sleeve portion 22 of the reinforcement member 12 can be secured to the pole portion 16 via welding, fasteners, or other connecting methods or structures. For example, one or holes can be drilled in the pole portion 16 of the existing light pole through the apertures 42 of the sleeve portion 22. Fasteners can be inserted through the apertures 42 and through the holes drilled in the pole portion 16 to connect the sleeve portion 22 to the pole portion 16.

Locking Hand Hole Cover

Light poles often include hand holes at or near the base of the light pole to facilitate access to the inner wiring of the pole. With rising values of copper and other metals, wire theft has become increasingly common.

FIGS. 1, 3, and 8-11 illustrate embodiments of locking hand hole covers configured to inhibit or prevent unauthorized access to an interior of a light via the hand hole. As illustrated in FIGS. 8-11, a locking hand hole cover 60 can include a cover frame 62. The cover frame 62 can be sized and shaped to fit around a perimeter of a hand hole 18. The cover frame 62 can include a front side 63*a* and a back side 63*b*. The back side 63*b* can be configured to abut an outer surface of pole when the cover 60 is installed over the hand hole of the pole. In some embodiments (e.g., when installing on a polygonal pole), the back side 63*b* of the cover frame 62 can have a planar shape. In some embodiments (e.g., when installing on a round pole), the back side 63*b* of the cover frame 62 can have a concave shape. Many other shapes are possible for installations on poles of various shapes.

The cover 60 can include a mating plate 64 configured to fit within the cover frame 62. In some embodiments, mating plate 64 is attached to the cover frame 62 via welding or other attachment methods/structures. In some embodiments, the mating plate 64 is not welded to the cover frame 62, and is configured to abut an abutment within the cover frame 62 when the fasteners, described below, are tightened.

The cover 60 can include a backing bar assembly. The backing bar assembly can include a backing bar 66. The backing bar 66 can be configured to interact with the mating plate 64 via one or more fasteners 68 or other connection devices/structures. As illustrated, the cover can include a cover plate 70 configured to inhibit or prevent unauthorized access to the mating plate 64 when the cover plate 70 is installed.

An aperture 72 can extend through a wall of the cover frame 62. The aperture 72 can be configured to receive at least a portion of a lock 74 (e.g., a pad lock). The mating plate 64 can include a loop aperture 76. The loop aperture 76 can be sized and shaped to receive at least a portion of a lock loop 78 of the cover plate 70.

Figure 10:
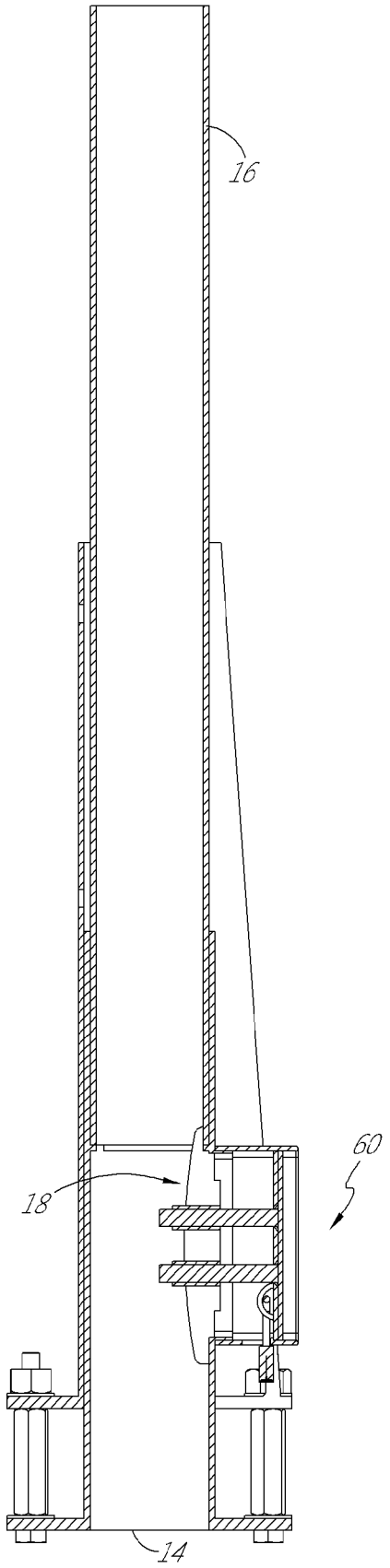
FIG. 10 is a cross-sectional view of the light pole repair assembly of FIG. 1, along the cut plane A-A.
Figure 11:
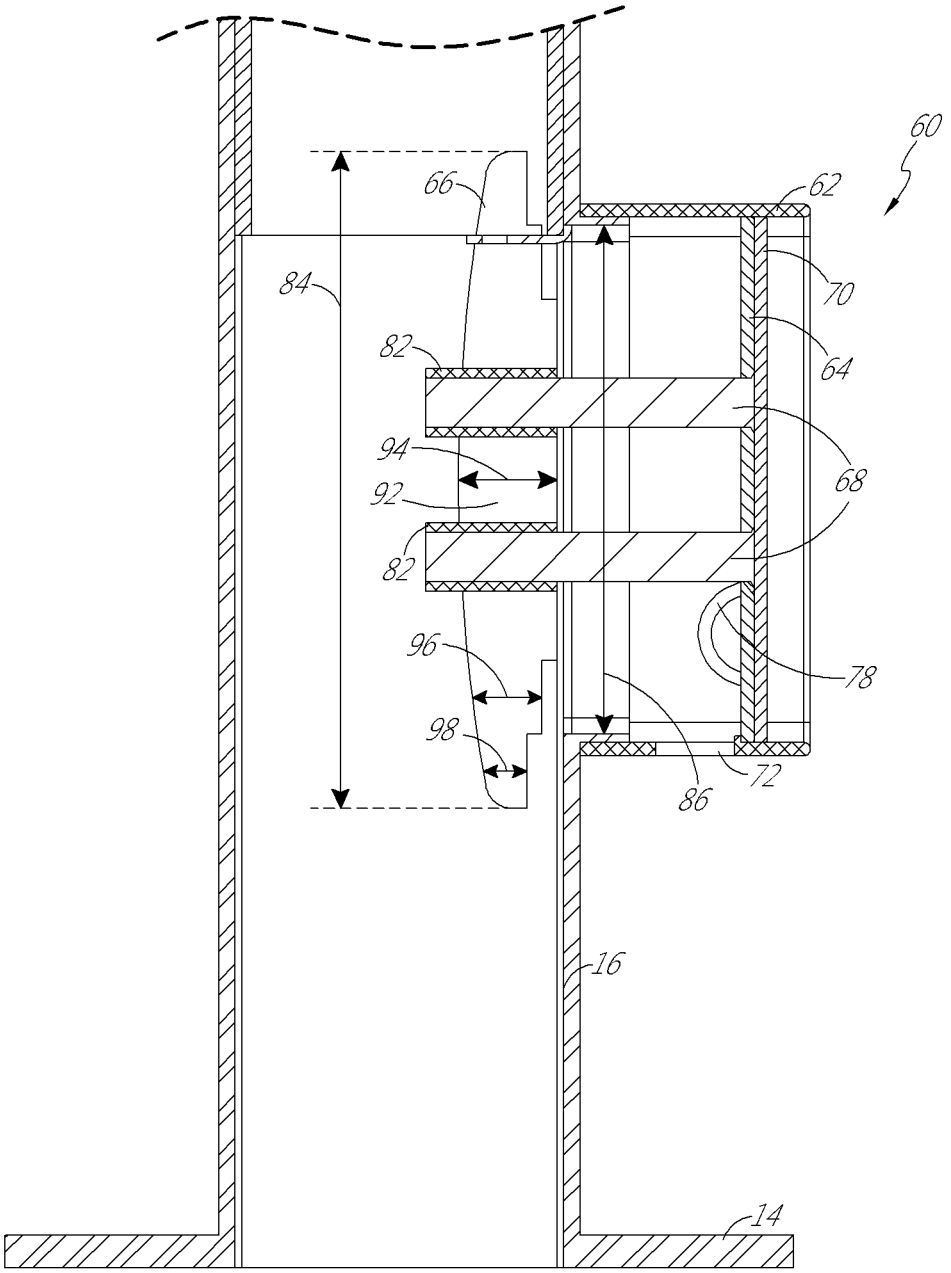
FIG. 11 is a close up cross-sectional view of a locking hand hole cover, along the cut plane A-A of FIG. 1.

As illustrated in FIGS. 10 and 11, the backing bar 66 can be positioned at least partially within an interior of the existing pole (or within the pole portion 110 of the modular pole base 102, described below). As illustrated, a length 84 of the backing bar 66 is greater than a height 86 of the hand hole 18. In some embodiments, the length 84 of the backing bar 66 is greater than a width of the hand hole 18. Preferably, the length 84 of the backing bar 66 is long enough that bar 66 cannot be removed from the pole through the hand hole 18 without rotation of the backing bar 66 about an axis of rotation parallel to the plane of the cover plate 70 when the locking hand hole cover 60 is fully installed as illustrated in FIG. 11.

The one or more fasteners 68 (e.g., bolts) can be inserted through one or more lock apertures 80 in the mating plate 64. A portion of the one or more fasteners 68 can be mated with a connection portion 82 (e.g., a threaded channel) of the backing bar 66. Tightening of the one or more fasteners 68 with respect to the backing bar 66 (e.g., via a screw driver, wrench, or other appropriate tool) can draw the mating plate 64 and cover frame 62 toward the backing bar 66. Movement of the cover frame 62 toward the backing bar 66 can continue until the cover frame 62 and backing bar 66 firmly abut the outer and inner surface of the pole, respectively. Abutment of the cover frame 62 and backing bar 66 against the wall of the light pole can secure the cover frame 62 to the light pole and around the hand hole 18. In some embodiments, the mating frame 64 includes one or more viewing apertures 81 configured to facilitate visual confirmation of the alignment and/or attachment of the backing bar 66 and cover plate 62.

Upon securement of the cover frame 62 around the hand hole 18, the cover plate 70 can be coupled with the mating plate 64. For example, the lock loop 78 of the cover plate 70 can be inserted through the loop aperture 76 of the mating plate 64. A shank portion 88 of the lock 74 can be inserted through the lock loop 78 and the lock 74 can be transitioned to a locked configuration. Coupling of the cover plate 70 to the mating plate 64 can inhibit or prevent unauthorized access to the interior of the pole (e.g., to the wires within the pole) through the hand hole.

As illustrated in FIG. 11, the loop 78 can be positioned such that the shank portion 88 of the lock 74 is positioned entirely within the cover frame 62. Positioning the lock shank portion 88 within the cover frame 62 can inhibit or prevent cutting or other damage to the shank portion 88 of the lock when the locking hand hole cover 60 is installed over a hand hole 18.

The backing plate 66 can include one or more stepped portions 90. The stepped portions 90 can have progressively smaller heights (e.g., as measured perpendicular to the length 84 of the bar 66 in the plane of the page of FIG. 11) moving upward and downward from a center portion 92 of the bar 66. For example, a height 94 of the center portion 92 of the backing bar 66 can be greater than a height 96 of a first lateral portion of the backing bar 66 adjacent the center portion 92. In some embodiments, the height 96 of the first lateral portion of the backing bar 66 is greater than a height 98 of a second lateral portion of the backing bar 66 adjacent the first lateral portion opposite the center portion 92.

The stepped portions 90 of the backing plate 66 can engage with the perimeter of the hand hole 18 when the cover 60 is installed over the hand hole 18. Engagement between the stepped portions 90 of the backing plate 66 and the perimeter of the hand hole 18 can inhibit or prevent vertical (e.g., up and down in FIG. 11) movement of the cover 60 with respect to the hand hole 18.

In some embodiments, the cover frame 62 and/or mating plate 64 can include a partitioning wall (not shown). The partitioning wall can extend between the back side 63*b* of the cover frame 62 and the mating plate 64. In some embodiments, the partitioning wall defines a lower portion of the interior of the cover frame 62, in which the lock loop 78 and lock shank 88 are positioned when the cover 60 is installed. The partitioning wall can separate the lower portion of the interior of the cover frame 62 from the interior of the pole when the cover 60 is installed.

A method of installing the hand hole cover 60 can include inserting the backing bar 66 into the pole through the hand hole 18. The one or more fasteners 68 can be inserted through the one or more lock aperture 80 of the mating plate 64. In some embodiments, the one or more fasteners 68 are inserted into and/or connected with the connection portions 82 of the backing plate 66.

The one or more fasteners 68 can be tightened to draw the cover frame 62 toward the backing bar 66 and into a secure engagement with the wall of the pole. In some embodiments, the lock loop 78 of the cover plate 70 can be inserted through the loop aperture 76 of the mating plate 64. The shank portion 88 of a lock 74 can be inserted through the loop 78 and the lock 74 can be transitioned to a locked configuration.

In some applications, the cover frame 62 to may be welded or otherwise connected directly onto an exterior surface of the pole around the hand hole 18. For example, the cover frame 62 may be constructed as part of the reinforcement member 12 or as part of the poles base 102 described below. In some such applications, the backing bar 66 and/or fasteners 68 are not needed. The mating frame 64 may, in addition to the loop aperture 76, have a single window through which a person's hand can fit rather than, or in addition to, the plurality of viewing apertures 81.

Modular Pole Assembly

In some applications, it may be desirable to replace the base portion of an existing pole without replacing the entire pole. For example, the base of the pole, or some segment near the base, may be so extensively damaged that repair is deemed unfeasible In some cases, it may be desirable to utilize a modular pole assembly wherein each of the major components (e.g., the base, the pole, the light fixture, etc.) are shipped and inventoried separately. For example, it may be advantageous for a specific contractor to inventory light pole base portions while purchasing separate pole portions custom sized for a given installation. In some case, pole portions can be purchased from local metal shops and cut to the desired length. In some such cases, the contractor can save inventor space and freight costs through purchase of pole portions from local providers, rather than from centralized light pole assembly distributors.

Figure 12:
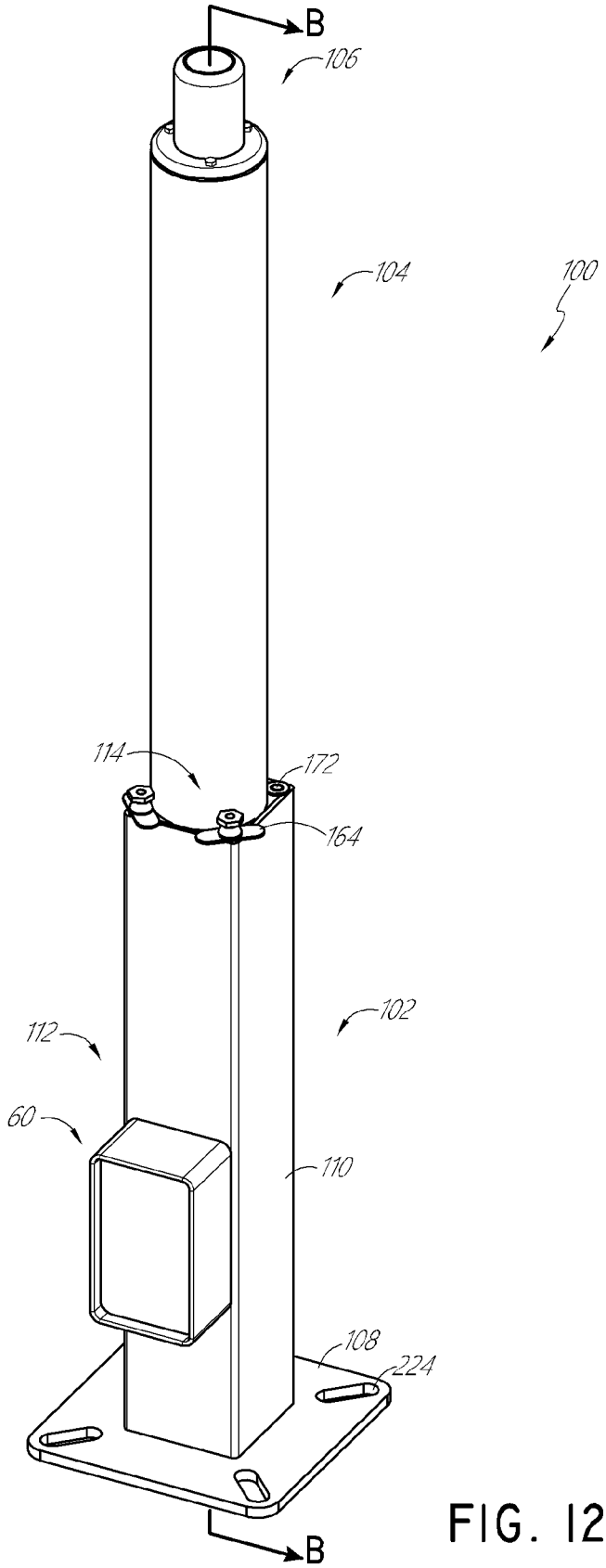
FIG. 12 is a perspective view of a modular light pole assembly.

FIG. 12 illustrates an embodiment of a modular light pole assembly 100. The modular light pole assembly 100 can include a pole base 102. The assembly 100 can include a pole portion 104 connected to and/or inserted into a portion of the pole base 102. In some embodiments, the modular light pole assembly 100 can include a fitter 106 (e.g., cap) connected to an upper end of the pole portion 104.

In some embodiments, the pole base 102 includes a pole base plate 108. The pole base 102 can include a pole base sleeve 110 connected to the pole base 102 (e.g., via welding or other connection methods/structures). The pole base sleeve 110 can be hollow, having an inner surface and an outer surface. In some embodiments, the pole base sleeve 110 can include a hand hole 112. The hand hole 112 can be configured to connect with the locking hand hole cover 60 as described above.

Figure 13:
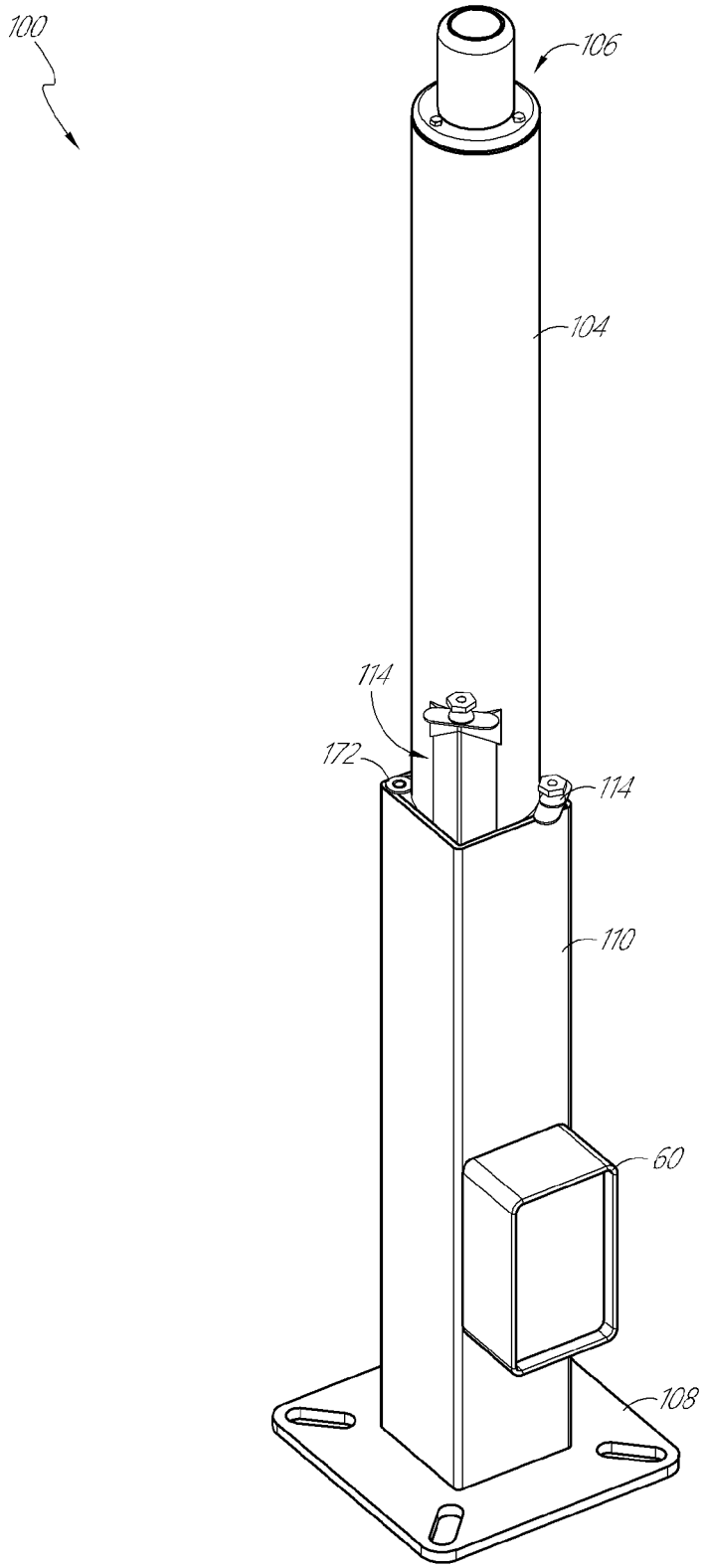
FIG. 13 is a perspective view of the modular light pole assembly of FIG. 12 with one wedge bolt positioned in a raised position.

An upper end of the pole base sleeve 110 can be configured to receive a lower end of the pole portion 104. In some embodiments, the lower end of the pole portion 104 is connected to the upper end of the pole base sleeve 110 via fasteners, welding, or some other connection structure or method. For example, as illustrated in FIG. 13, the modular pole assembly 100 can include one or more wedge bolts 114 configured to connect the lower end of the pole portion 104 to the upper end of the pole base sleeve 110.

As illustrated in FIGS. 14-17, each of the wedge bolts 114 can include a wedge sleeve 116. The wedge sleeve 116 can have a first end 118 and a second end 120 and a length 121 defined between the first end 118 and the second end 120. In some embodiments, the wedge sleeve 116 can include a plurality of wedge portions. For example, the wedge sleeve 116 can include a first wedge portion 122. The first wedge portion 122 can include a first surface 124 at or near the first end 118 of the sleeve portion 116. As illustrated, the first wedge portion 122 can include a second surface 126 opposite the first surface 124.

The second surface 126 can lie on a plane offset from a longitudinal axis 127 of the wedge sleeve 116 by an offset angle 128. In some embodiments, the offset angle 128 of the second surface 126 of the first wedge portion 122 is between 0° and 90°. In some embodiments, the angle 128 is between 30° and 85°, between 5° and 50°, between 35° and 55°, and/or between 40° and 75°. Many variations are possible.

The wedge sleeve 116 can include a second wedge portion 130. The second wedge portion 130 can be positioned on a side of the first wedge portion 122 opposite the first end 118 of the wedge sleeve 116. The second wedge portion 130 can include a first surface 132 lying on a plane offset from the longitudinal axis 127 of the sleeve 116 by an offset angle 134. The offset angle 134 of the first surface 132 of the second wedge portion 130 can be substantially equal (e.g., within ±10°) to the offset angle 128 of the second surface 126 of the first wedge portion 122. In use, the first surface 132 of the second wedge portion 130 can be configured to contact the second surface 126 of the first wedge portion 122.

The second wedge portion 130 can include a second surface 136 between the first surface 132 of the second wedge portion 130 and the second end 120 of the wedge sleeve 116. The second surface 136 of the second wedge portion can lie on a plane offset from the longitudinal axis 127 of the sleeve 116 by an offset angle 138. In some embodiments, the offset angle 138 of the second surface 136 of the second wedge portion 130 is between 0° and 90°. In some embodiments, the angle 138 is between 30° and 85°, between 5° and 50°, between 35° and 55°, and/or between 40° and 75°. Many variations are possible.

The wedge sleeve 116 can include a third wedge portion 140. The third wedge portion 140 can be positioned between the second wedge portion 130 and the second end 120 of the wedge sleeve 116. The third wedge portion 140 can include a first surface 142 lying on a plane offset from the longitudinal axis 127 of the sleeve 116 by an offset angle 144. The offset angle 144 of the first surface 142 of the third wedge portion 140 can be substantially equal (e.g., within ±10°) to the offset angle 138 of the second surface 136 of the second wedge portion 130. In use, the first surface 142 of the third wedge portion 140 can be configured to contact the second surface 136 of the second wedge portion 130.

Figure 17:
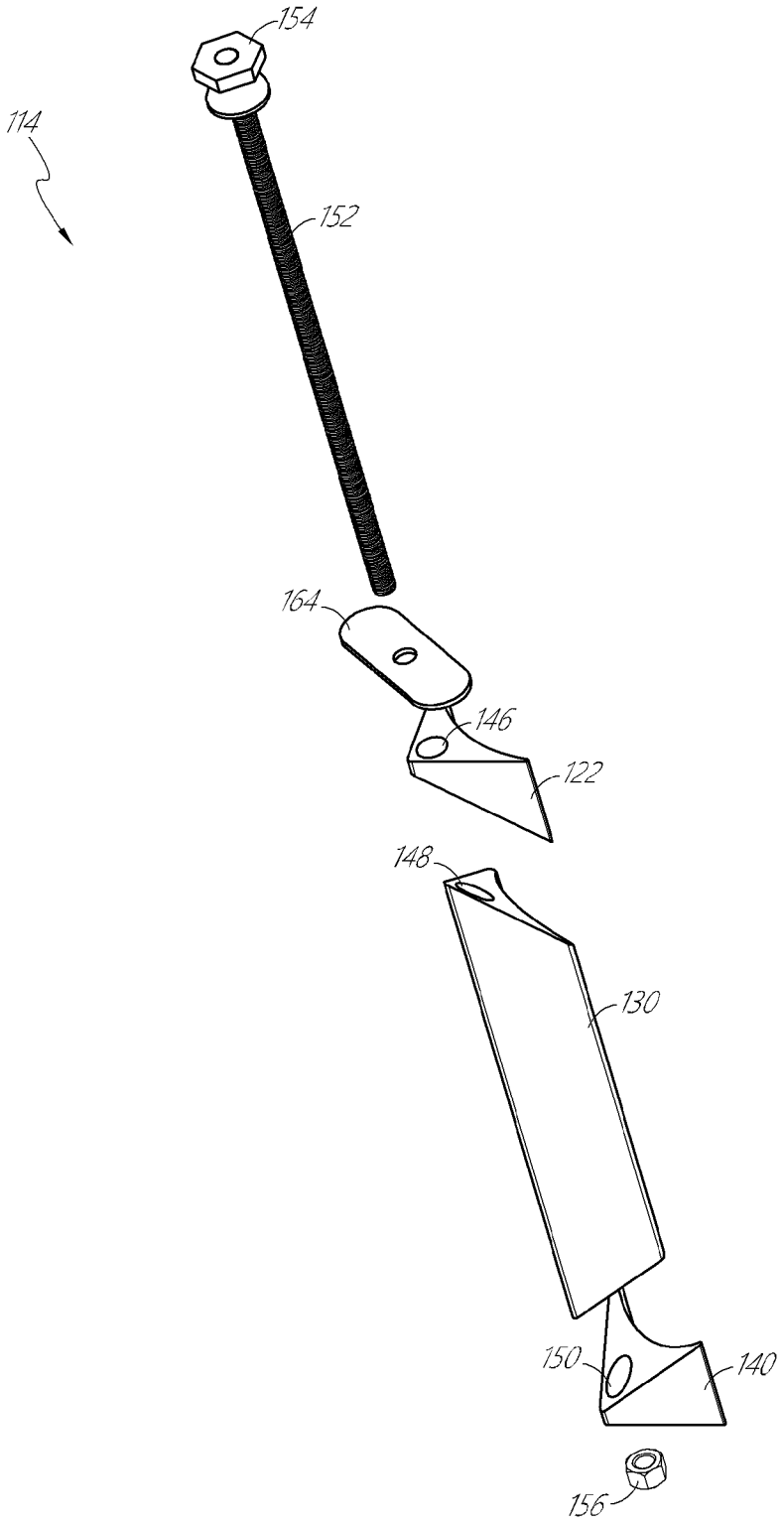
FIG. 17 is an exploded view of the wedge bolt of FIG. 14.

As illustrated in FIG. 17, the wedge portions 122, 130, 140 can include connector channels 146, 148, 150, respectively. The wedge bolt 114 can include an elongate member 152. The elongate member 152 (e.g., a bolt or other fastener) can be configured to be inserted through the connector channels 146, 148, 150 of the wedge portions 122, 130, 140. One or more of the connector channels 146, 148, 150 can have a cross-sectional area (e.g., a diameter) greater than a cross-sectional area of the elongate member 152 to permit lateral movement of one or more of the wedge portions 122, 130, 140 with respect to the elongate member 152. The elongate member 152 can be configured to receive user input (e.g., rotational force, axial force). For example, the elongate member 152 can include a head portion 154 at a first end. The head portion 154 can be sized and shaped (e.g., hexagonal, square, flat head, Phillips head) to receive user input via one or more tools (e.g., wrenches, screw drivers, drills, etc.).

In some embodiments, the wedge bolt 114 includes a nut 156 or other fastening structure configured to engage with a second end of the elongate member 152. The nut 156 can be affixed to one of the wedge portions (e.g., the second wedge portion 130, third wedge portion 140, or other wedge portion furthest from the first end 118 of the wedge sleeve 116). Affixing the nut 156 to a wedge portion can facilitate compression (e.g., along the axis 127) of the sleeve 116 when the elongate member 152 is tightened into the nut 156. In some embodiments, the nut 156 includes a cam (not shown) configured to engage with an inner wall of the base sleeve 110 and/or with an outer wall of the pole portion 104 to inhibit rotation of the nut 156 as the elongate member 152 is tightened into the nut 156. In some embodiments, the third wedge portion 140 includes threading in the connector channel 150 to facilitate compression of the sleeve 116 when the elongate member 152 is tightened into the connector channel 150. Compression of the sleeve 116 parallel to the axis 127 can push the second wedge portion 130 in a lateral direction 158. Movement of the second wedge portion 130 in the lateral direction 130 can be facilitated by the interface between the surfaces 126, 132 as the sleeve 116 is compressed. In some embodiments, the movement of the second wedge portion 130 in the lateral direction 130 can wedge the wedge bolt 114 between the outer surface of the pole portion 104 and the inner surface of the base sleeve 110 to connect the pole portion 104 to the base sleeve 110.

Figure 14:
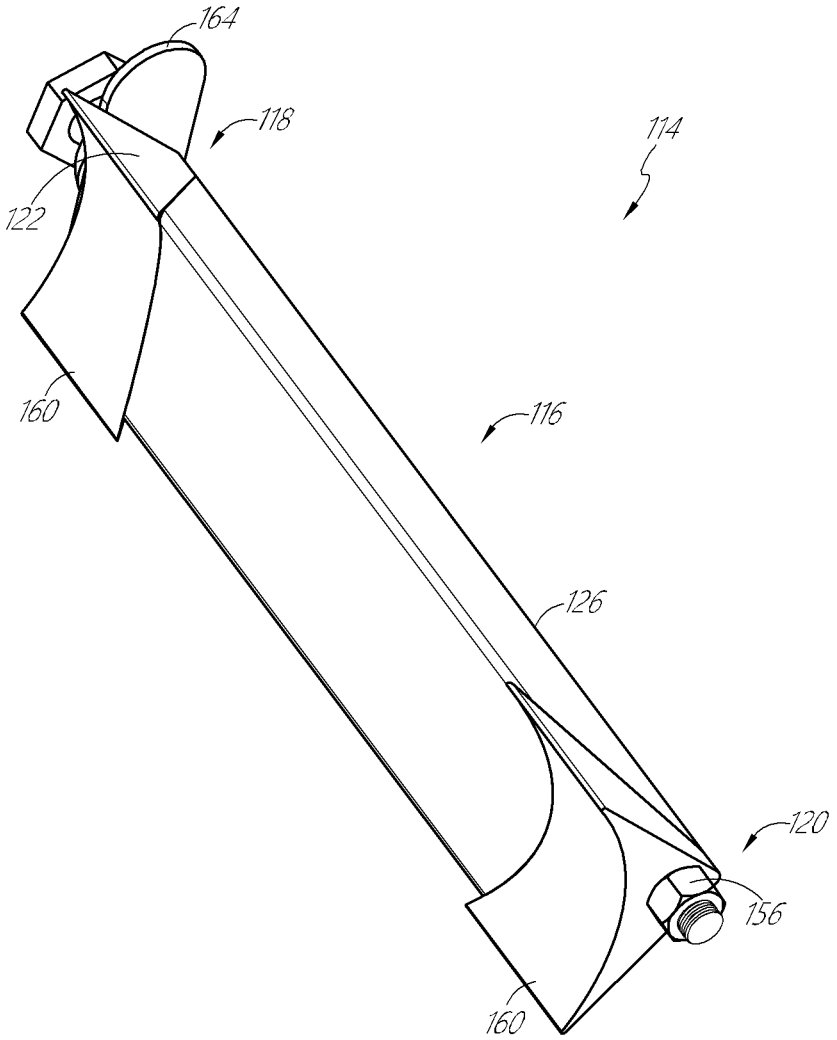
FIG. 14 is a bottom perspective view of a wedge bolt.
Figure 15:
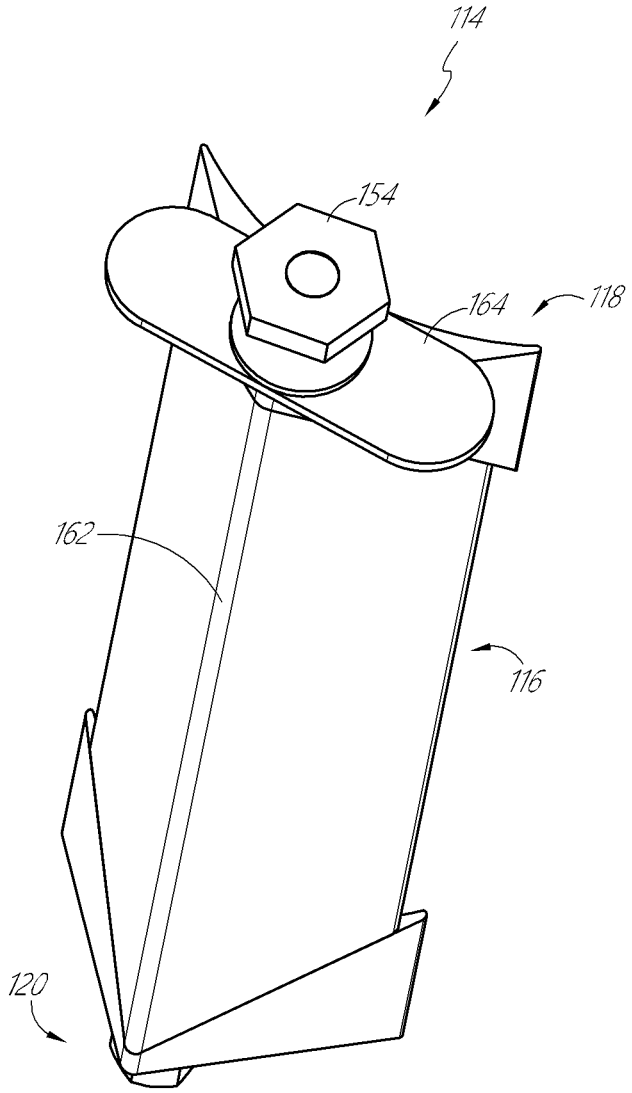
FIG. 15 is a top perspective view of the wedge bolt of FIG. 14.

As illustrated in FIGS. 14 and 15, the wedge bolts 114 (e.g., one or more of the wedge portions) can include a pole-engaging surface 160. The pole-engaging surface 160 can be generally shaped (e.g., as a concave surface) to contact the pole portion 104 along at least 25% of the surface area of the pole-engaging surface 160 (e.g., of the first and third wedge portions 122, 140). In some embodiments, the pole-engaging surface 160 of the wedge bolt 114 can be shaped to contact the pole portion 104 over at least 10%, at least 20%, at least 30%, at least 50%, at least 65%, and/or at least 80% of the surface area of the pole-engaging surface 160. Many variations are possible.

In some embodiments, the wedge bolts 114 (e.g., the second web portion 130) can include a base sleeve engaging surface 162. The base sleeve engaging surface 162 can be generally shaped (e.g., as a convex and/or cornered surface) to contact the inner surface of the base sleeve 110 over at least 15% of the surface area of the base sleeve engaging surface 162. In some embodiments, the base sleeve engaging surface 162 can be shaped to contact the inner surface of the base sleeve 110 over at least 10%, at least 20%, at least 30%, at least 50%, at least 65%, and/or at least 80% of the surface area of the base sleeve engaging surface 162. Many variations are possible.

As illustrated in FIGS. 12 and 13, the wedge bolts 114 can be positioned between the outer surface of the pole portion 104 and the inner surface of the sleeve 110. The wedge bolts 114 can include washers 164. The washers 164 can be configured to limit the extent to which the wedge bolts 114 are inserted into the space between the outer surface of the pole portion 104 and the inner surface of the sleeve 110. For example, the washers 164 can engage an upper surface of the sleeve 110. Limiting the insertion of the wedge bolts 114 can maintain the head portions 154 of the elongate members 152 outside of the space between the outer surface of the pole portion 104 and the inner surface of the sleeve 110, thereby increasing access to the head portions 154 for user input via tools or other input methods or devices.

Figure 16:
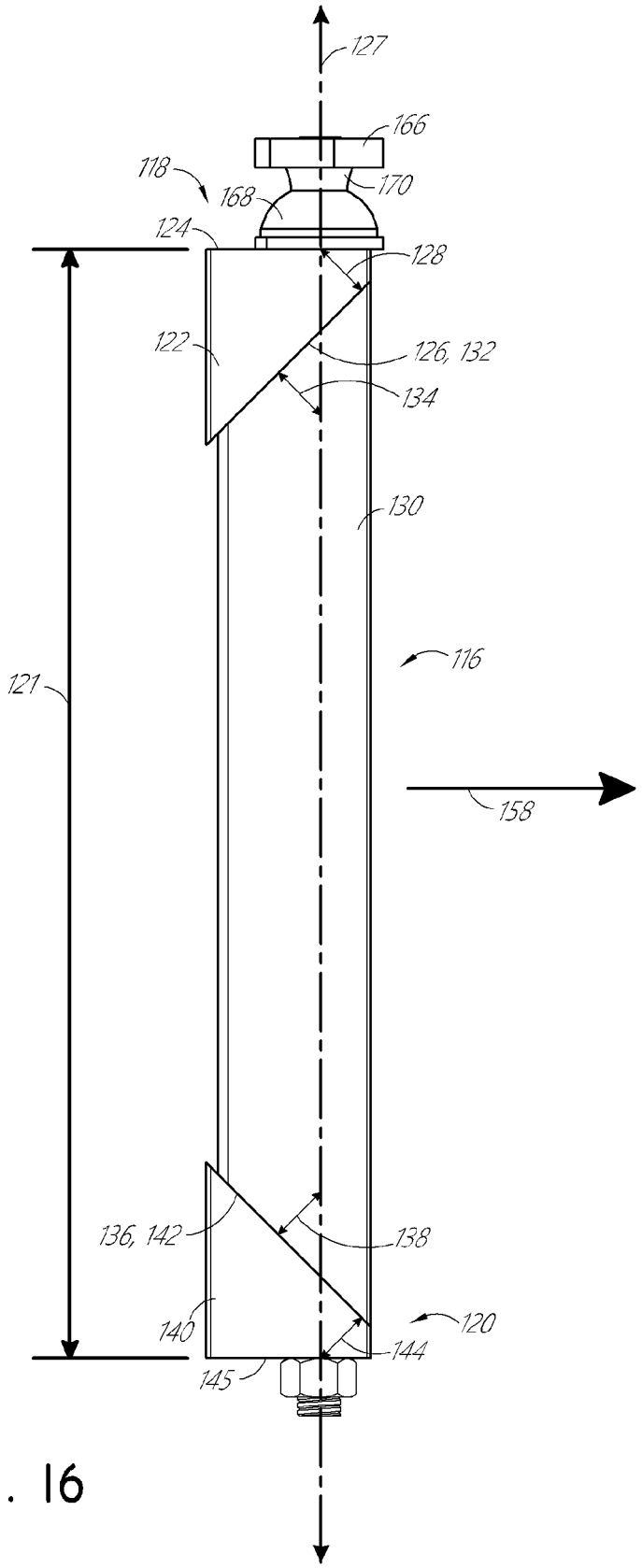
FIG. 16 is a side plan view of the wedge bolt of FIG. 14.

As illustrated in FIGS. 16 and 17, the head portions 154 of the elongate members 152 can include a user input portion 166. The user input portion 166 can be, for example, a hexagonal or other polygonal head. The user input portion 166 can be connected to a tamper-resistant portion 168 via a neck 170. The tamper-resistant portion 168 can have a mounded shape or some other shape resistant to user input (e.g., resistant to manipulation by wrenches, screwdrivers, or other tools). The neck 170 can be configured (e.g., sized, shaped) to break away from the tamper-resistant portion 168 upon application of a threshold torque upon the user input portion 166. For example, the neck 170 can be configured to break away from the tamper-resistant portion 168 upon application of a torque greater than or equal to 15 foot-pounds (e.g., pounds-feet). In some embodiments, the break-away torque of the neck 70 is greater than 5 foot-pounds, greater than 20 foot-pounds, greater than 40 foot-pounds, greater than 45 foot-pounds, greater than 65 foot-pounds, and/or greater than 75 foot-pounds. Many variations are possible. In some embodiments, use of a break-away user input portion 166 can inhibit tampering with or removal of the wedge bolts 114 from the modular pole assembly 100 upon installation of the wedge bolts 144. In some cases, use of a break-away user input portion 166 can provide a visual and tactile confirmation that the wedge bolts 114 have been tightened sufficiently; thereby reducing the likelihood that the pole portion 104 is inadequately connected to the base sleeve 110.

Figure 18:
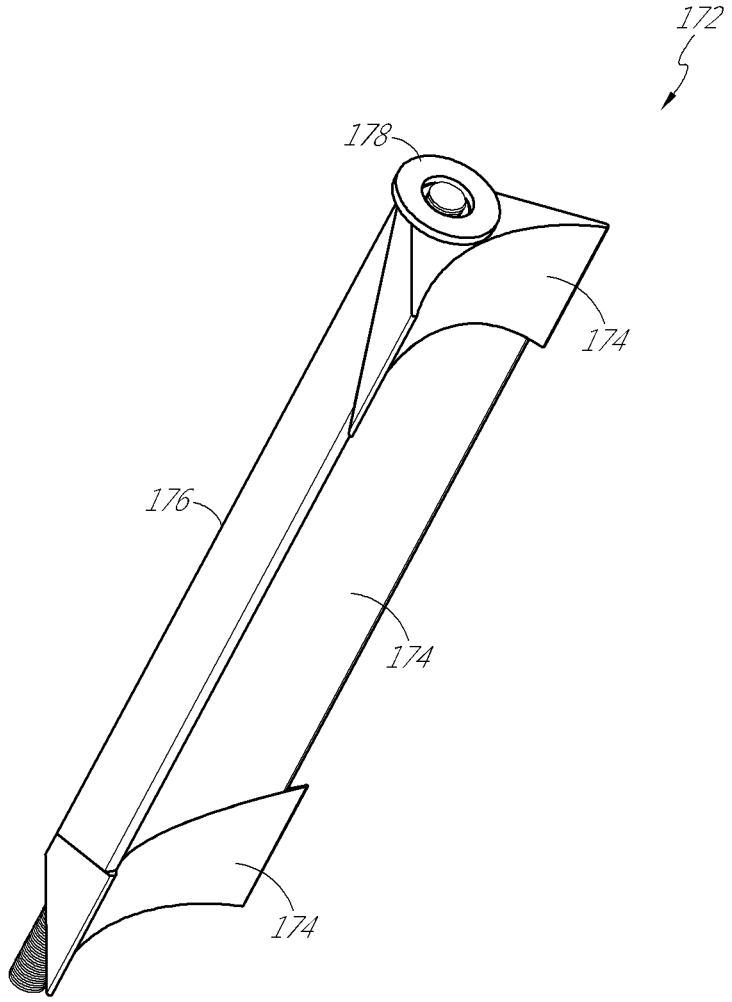
FIG. 18 is a top perspective view of a spacer.
Figure 19:
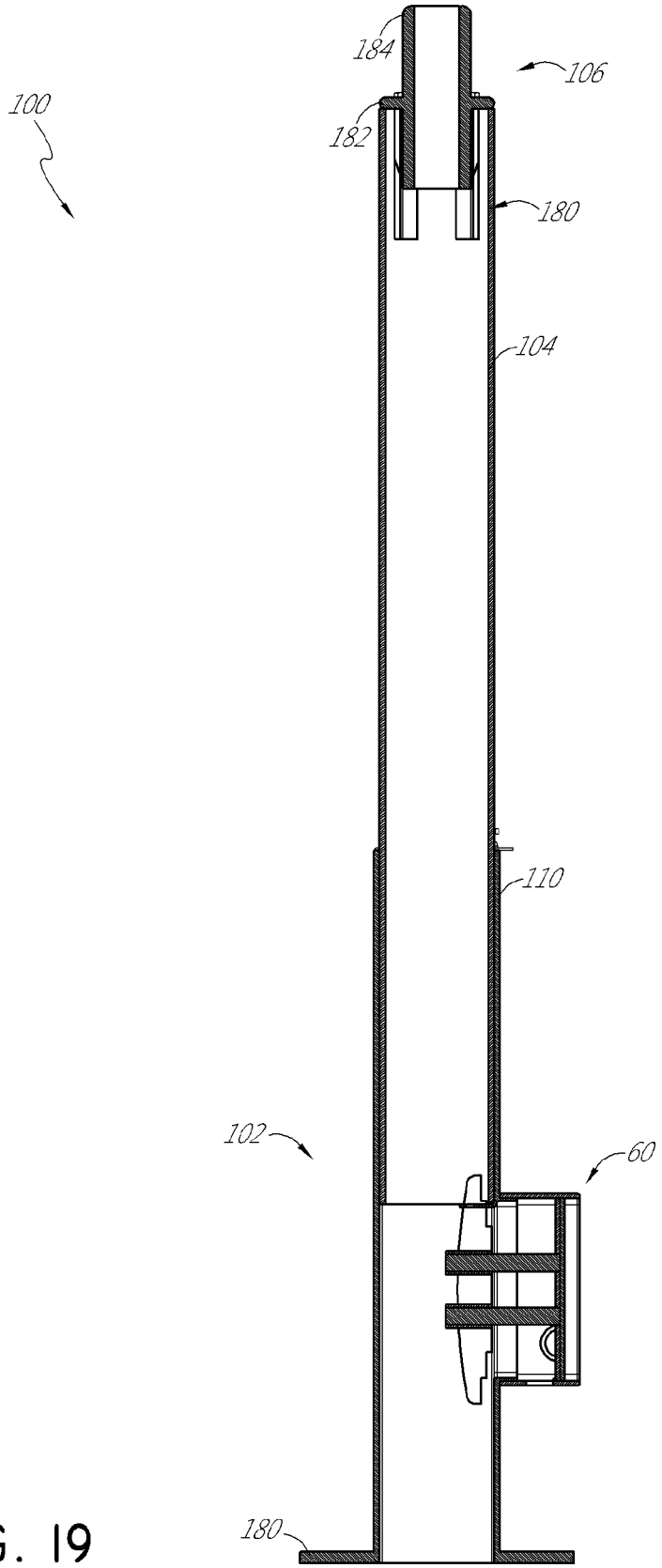
FIG. 19 is a cross-sectional view of the modular light pole assembly of FIG. 12 along the cut plane B-B.

In some embodiments, the modular pole assembly 100 includes one or more gap spacers 172. As illustrated in FIGS. 12 and 13, the gap spacers 172 can be positioned on sides of the pole portion 104 opposite the wedge bolts 114. As illustrated in FIG. 18, the gap spacers 172 can include a pole-engaging surface 174 and a sleeve-engaging surface 176. The pole-engaging surface 174 can have a same or similar shape as the pole-engaging surface 160 of the wedge bolts 114. In some embodiments, the sleeve-engaging surface 176 of the gap spacers 172 has a same or similar shape as the base sleeve engaging surface 162 of the wedge bolts 114. The gap spacers 172 can include washers 178 or other structures configured to limit the extent to which the gap spacers 172 are inserted into the space between the outer surface of the pole portion 104 and the inner surface of the sleeve 110.

As illustrated in FIGS. 19-22, the fitter 106 of the modular pole assembly 100 can connect to the upper end of the pole portion 104. The fitter 106 can include a cap mating portion 180 configured to mate with the upper end of the pole portion 104. In some embodiments, the fitter 106 includes a collar portion 182 connected to the mating portion 180 and positioned above the mating portion 180. The collar portion 182 can be configured to limit the extent to which the mating portion 180 is inserted into the upper end of the pole portion 104. In some embodiments, the fitter 106 includes a coupling portion 184 connected to and extending upward from the collar portion 182. The coupling portion 184 can be configured to couple with a light fixture (not shown) or other light pole component.

Figure 20:
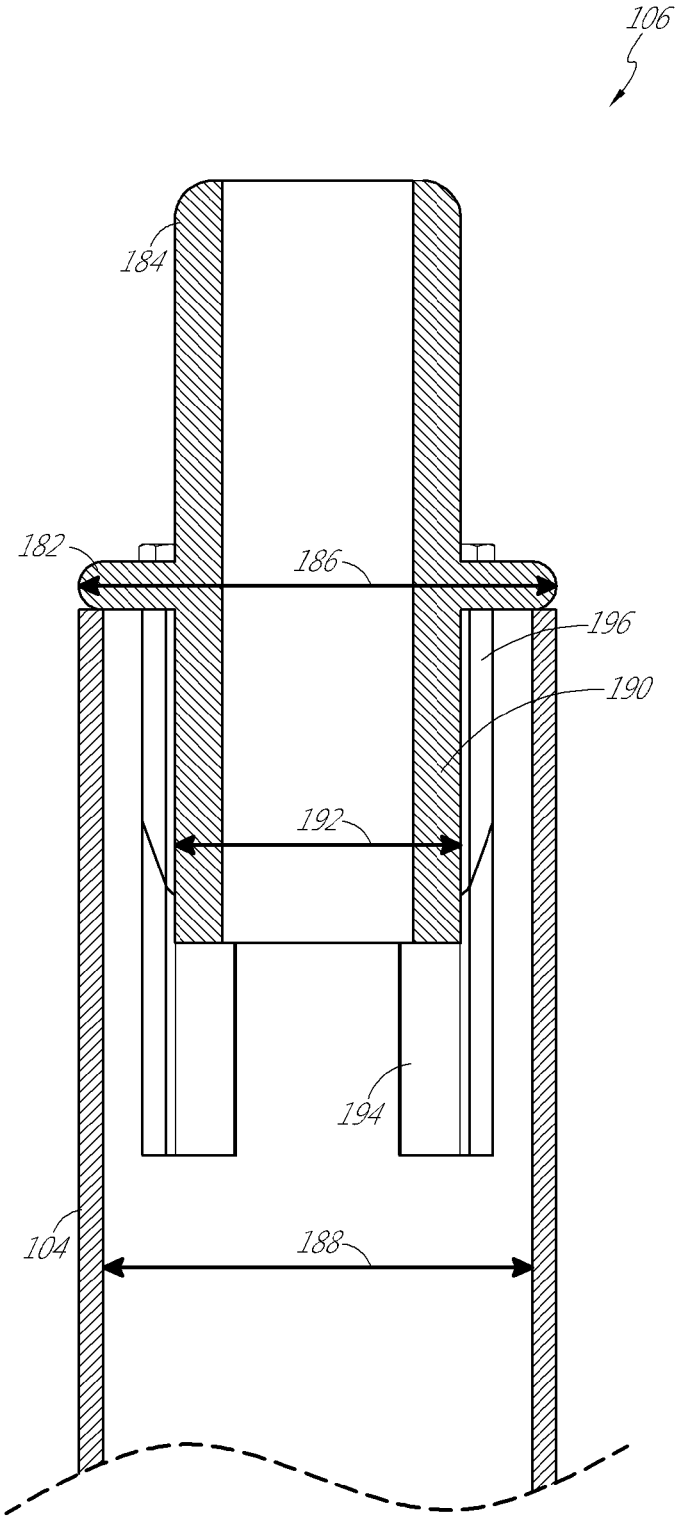
FIG. 20 is a close up cross-sectional view of a fitter of the modular light pole assembly of FIG. 12 along the cut plane B-B.

As illustrated in FIG. 20, a width 186 of the collar 182 can be greater than a width 188 of the inner surface of the pole portion 104. In some embodiments, the collar 182 is sized to abut the top end of the end pole portion 104 to permit the mating portion 180 to hang into the interior of the pole portion 104.

Figure 21:
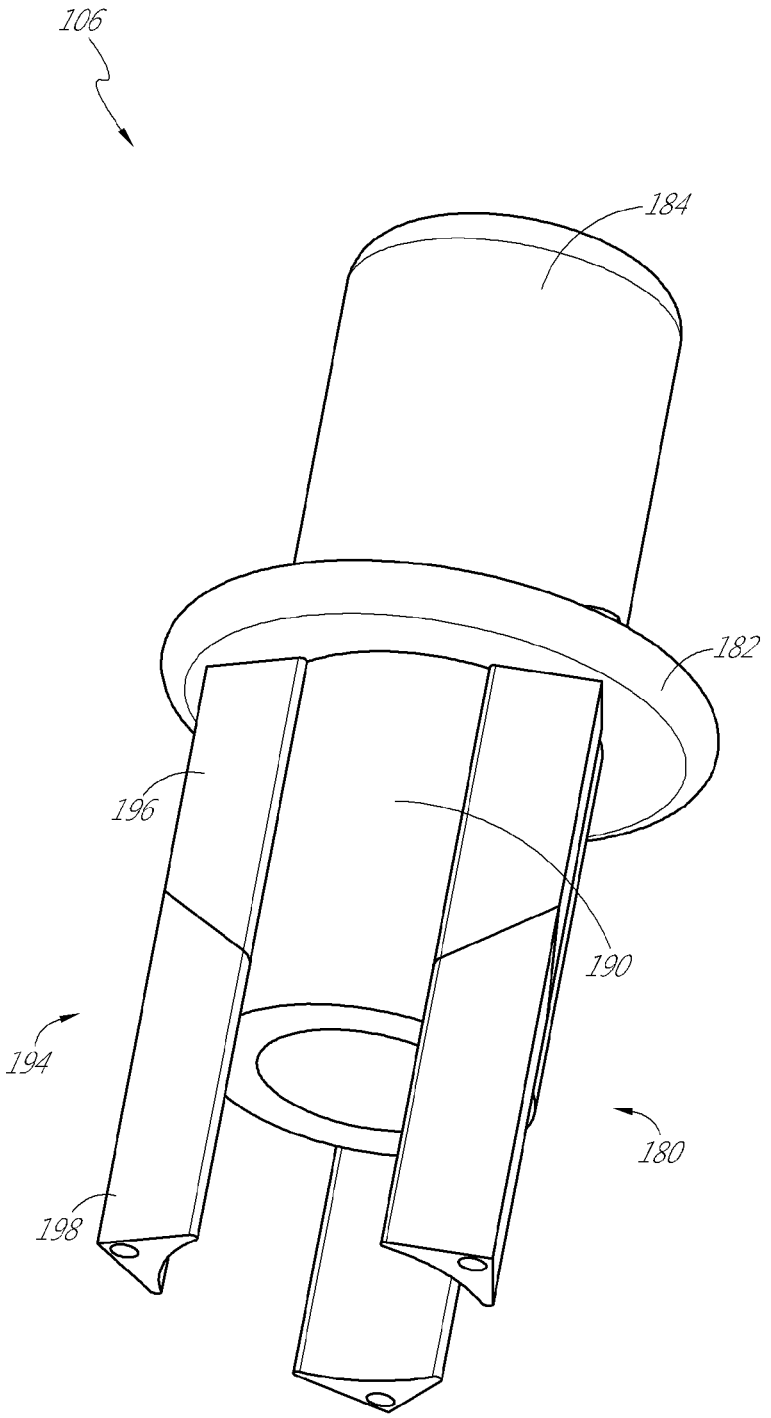
FIG. 21 is a perspective view of the fitter of FIG. 20.
Figure 22:
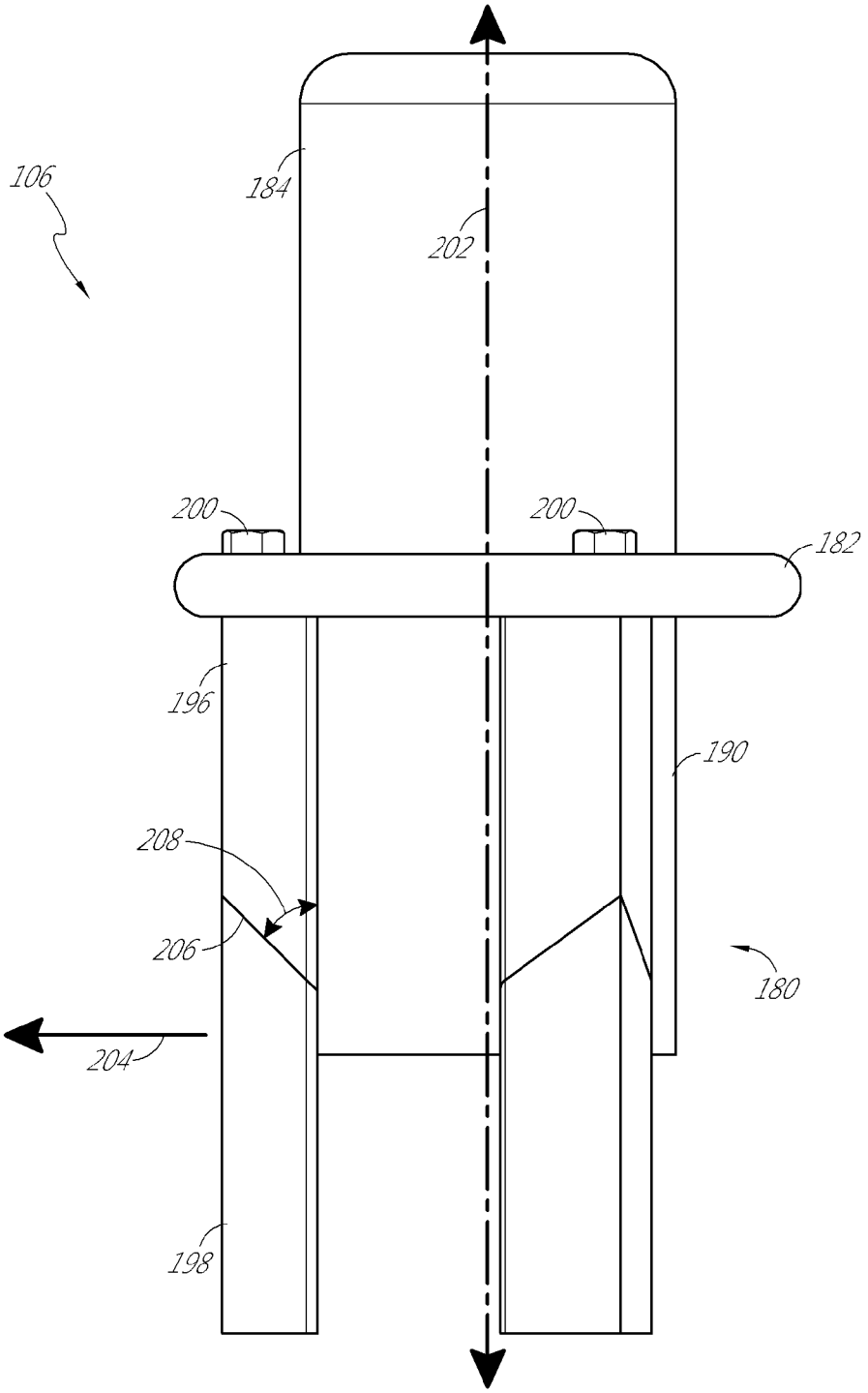
FIG. 22 is a side plan view of the fitter of FIG. 20.

As illustrated in FIGS. 20-22, the mating portion 180 can include a mating protrusion 190 extending downward from the collar 182. The mating protrusion 190 can have a width 192 that is less than the width 188 of the inner surface of the pole portion 104.

The mating portion 180 can include one or more cap wedge members 194. In some embodiments, the cap wedge members 194 perform a same or similar function as the wedge bolts 114. For example, each of the cap wedge members 194 can include a first cap wedge portion 196. The first cap wedge portion 196 can be connected to the collar portion 182 and/or to the mating protrusion 190.

The cap wedge members 194 can include a second wedge portion 198. The second wedge portion 198 can be connected to the first wedge portion 196 via an extended member (not shown). The extended member can be, for example, a bolt or other fastener. In some embodiments, the extended member can include a head portion 200. The head portion 200 can be the same as, or similar to, the user input portion 166 described above. In some embodiments, the head portion 200 is a hex head, a Phillips head, a flat head, or some other standard fastener head.

The extended member can be configured to pass through a connection channel (not shown) in the first cap wedge portion 196. In some embodiments, the extended member extends into and/or through a connection channel in the second cap wedge portion 198. For example, the second cap wedge portion 198 can include a connection channel having internal threading configured to engage with external threading on the extended member. In some embodiments, the second cap wedge portion 198 a nut (not shown) or other structure with inner threading attached to a bottom end of the second cap wedge portion 198.

Tightening of the extended member into the second cap wedge portion 198 can compress the cap wedge member 194 in a direction parallel to a longitudinal axis 202 of the fitter 106. Compression of the cap wedge member 194 can move the second cap wedge portion 198 in a lateral direction 204 toward the inner surface of the pole portion 104. For example, the first and second cap wedge portions 196, 198 can meet at an interface 206, wherein surfaces of each of the cap wedge portions lie on a plane offset from the axis 202 by an offset angle 208. Compression of the cap wedge member 194 can facilitate sliding of the second cap wedge portion 198 along the slanted interface 206 and outward toward the inner surface of the pole portion 104. Lateral/outward movement of the second cap wedge portion 198 can wedge the mating portion 180 into place within the upper end of the pole portion 104. In some embodiments, the mating portion 180 includes one or more cap wedge members 194 and one or more spacers having a shape generally similar to that of the wedge members 194 without use of an extended member.

In some cases, it is desirable to perform a light pole installation in more than one session. For example, an installer may wish to set the pole base 102 before he or she is necessarily ready to install the pole portion 104. In such cases, it may be desirable to limit access to an interior of the pole base 102 to inhibit or prevent theft of the wiring within the pole base 102 before the pole portion 104 is installed.

Figure 23:
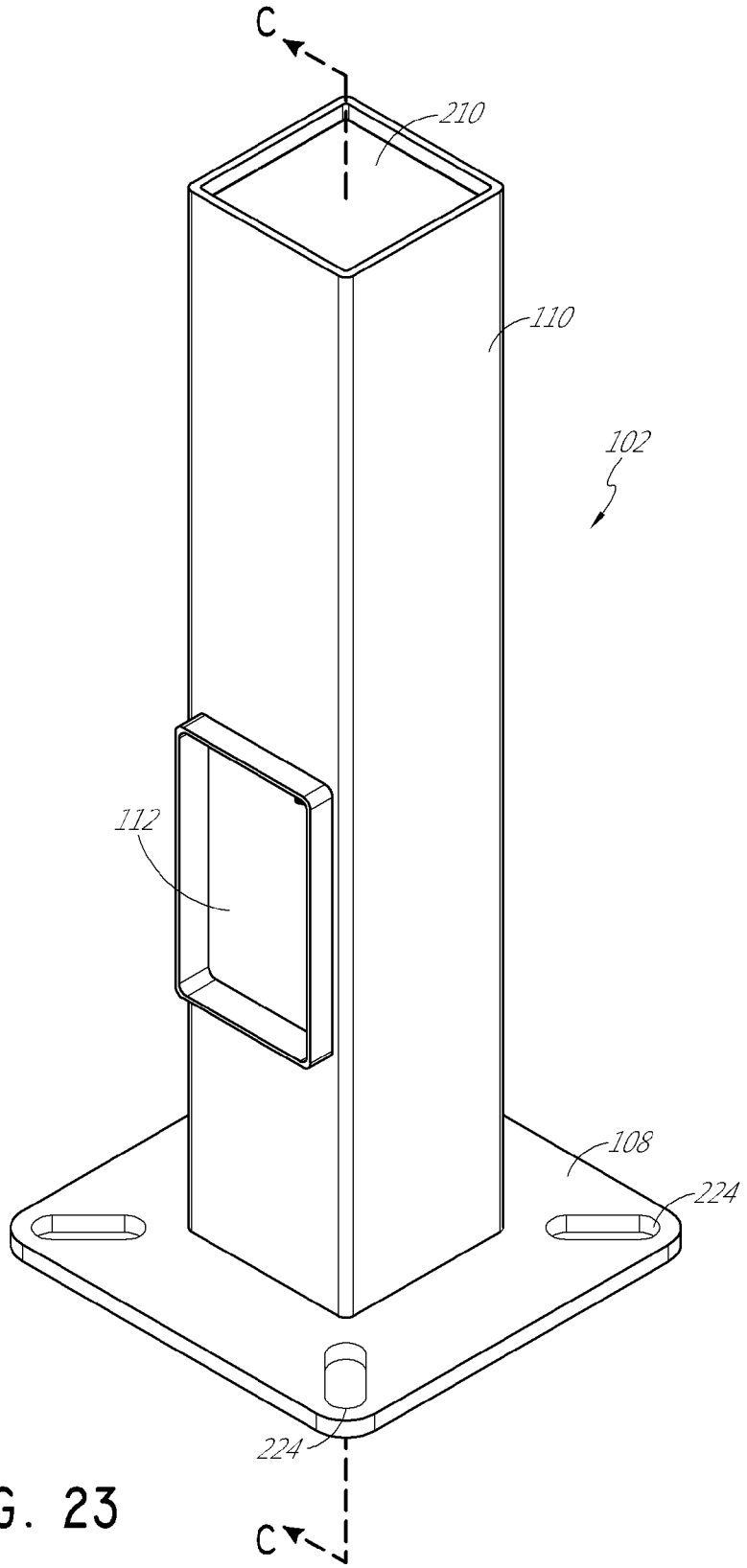
FIG. 23 is a perspective view of a modular pole base with a security cap.

As illustrated in FIG. 23, the modular pole assembly 100 can include a security cap 210. The security cap 210 can be installed into or onto an upper end of the pole base 102. The security cap 210 can be configured to limit or prevent unauthorized access to the interior of the pole base 102 via the upper end of the pole base 102. In some embodiments, a locking hand hole cover 60, as described above, is installed over the hand hole 112 of the pole base 102. Use of both the locking hand hole cover 60 and the security cap 210 can inhibit or prevent unauthorized access to the interior of the pole base once the base 102 is installed at an installation site.

Figure 24:
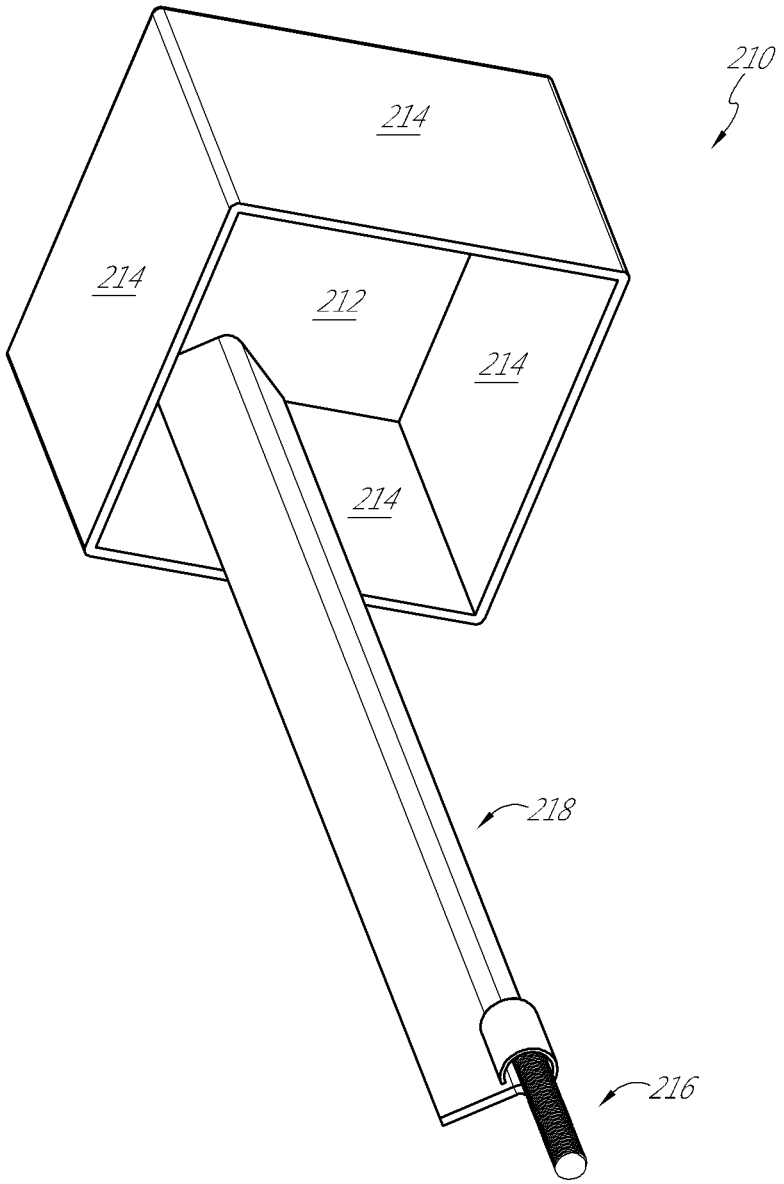
FIG. 24 is a perspective view of the security cap of FIG. 23.

As illustrated in FIG. 24, the security cap 210 can include an obstructing member 212. The obstructing member 212 can have a perimeter configured to fit into the upper end of the base sleeve 110 or over the pole base sleeve 110. The obstructing member 212 can include one or more side walls 214 extending from the obstructing member 212.

In some embodiments, the security cap 210 can be releasably connected to a portion of the pole base 102. For example, the security cap 210 can have a base-engagement portion 216. The base-engagement portion 216 can be a threaded bolt or other mating feature. In some embodiments, the base-engagement portion 216 is spaced from the obstructing member 212 by an extended portion 218.

Figure 25:
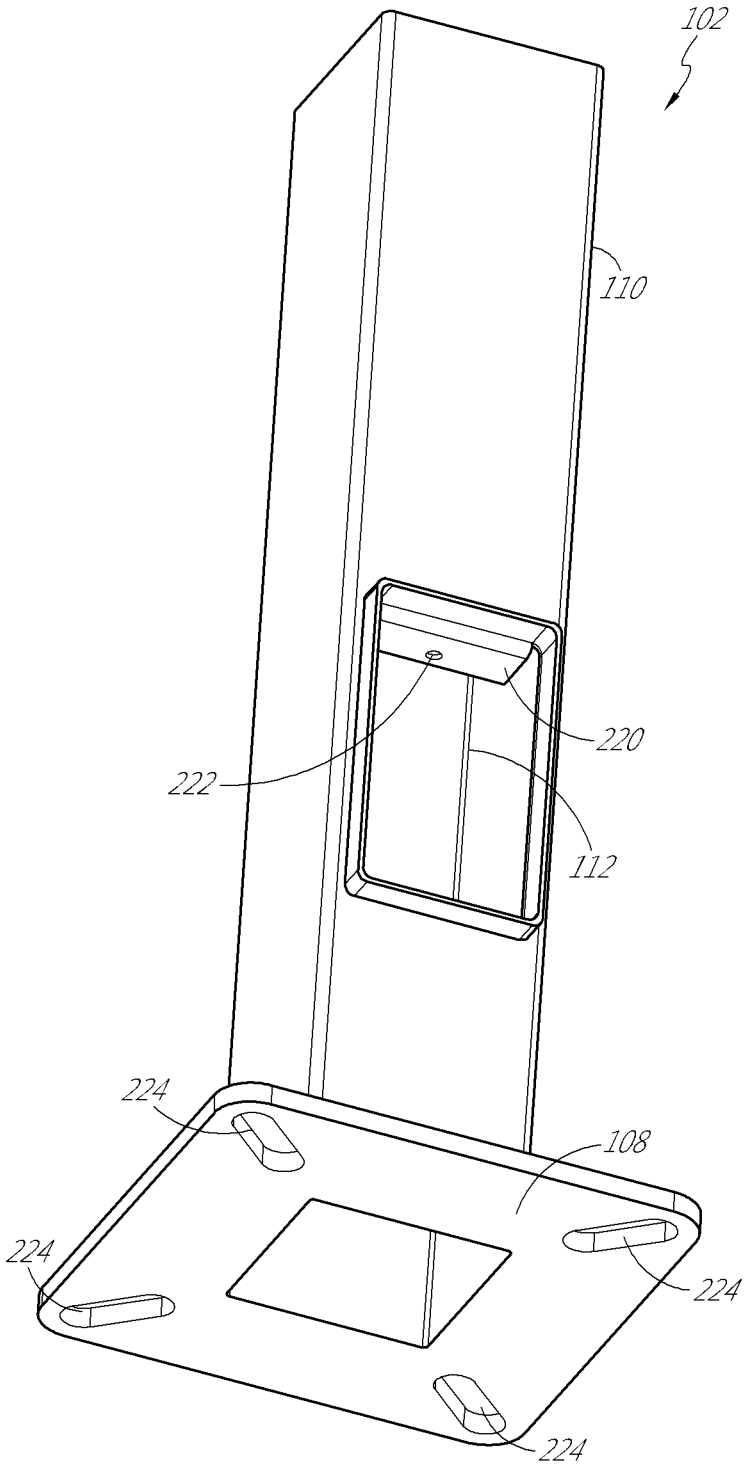
FIG. 25 is a bottom perspective view of the modular pole base of FIG. 23.
Figure 26:
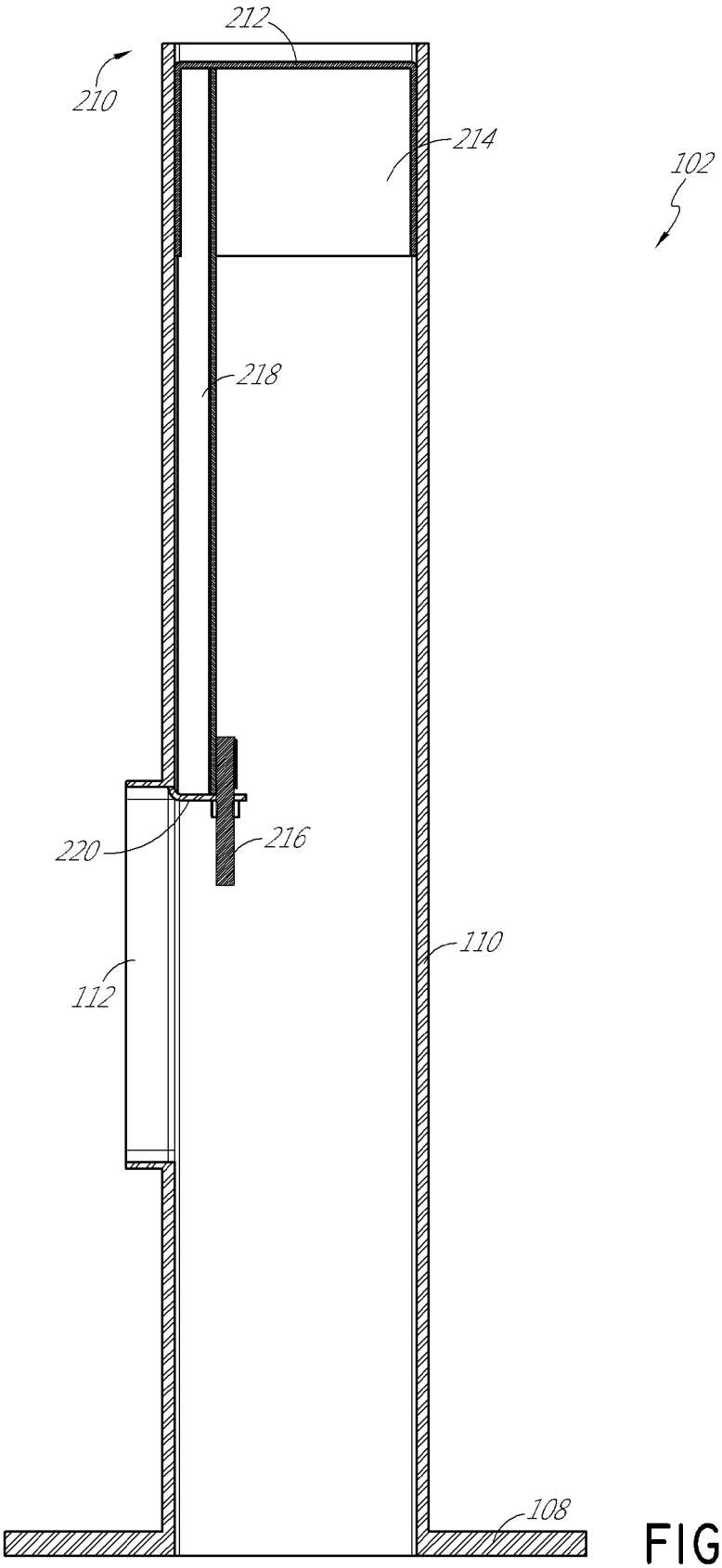
FIG. 26 is a cross-sectional view of the modular pole base of FIG. 23 along the cut plane C-C.

As illustrated in FIGS. 25 and 26, the pole base 102 can include at least one internal flange 220. The internal flange 220 can include an aperture 222 or other structure configured to couple with the base-engagement portion 216. In some embodiments, the at least one internal flange 220 can limit downward movement of the pole portion 104 during and/or after installation of the pole portion 104 into the pole base 102.

As illustrated in FIG. 26, the base-engagement portion 216 of the security cap 210 can be inserted through the aperture 222 of the internal flange 220. A nut or other fastening device can be secured over a lower end of the base-engagement portion 216 to secure the security cap 210 into or onto the upper end of the pole base 102. Upon securement of the security cap 210, the locking hand hole cover 60 can be installed over the hand hole 112 to inhibit or prevent unauthorized access to the base-engagement portion 216 to remove the security cap 210.

In some embodiments, the base plate 108 can be used as a template for setting anchor bolts for a light pole installation. The relatively small size and light weight of the modular pole base 102 (e.g., as compared with an entire light pole) can facilitate suspending the modular pole base 102 above the wet concrete as the anchor bolts set in the concrete. In some embodiments, the modular pole base 102 includes a plurality of holes 224 configured to receive anchor bolts. The anchor bolts can be aligned with the holes 224 during the setting process to reduce the likelihood that the anchor bolts are misaligned from the holes 224 of the modular pole base 102.

A method of installing the modular pole assembly 100 can include selecting an installation site. In some cases, the base plate 108 of the modular pole base 102 is used as a template to set anchor bolts at the installation (e.g., to set the bolts in concrete). The base plate 108 can be secured to the anchor bolts via standard connection devices (e.g., nuts, tamper-resistant connectors, etc.). In some embodiments, the base plate 108 is connected to the anchor bolts using locking nuts or propeller locks.

In some cases, wiring is inserted through a lower end of the modular pole base 102. The security cap 210 can be installed over the upper end of the modular pole base 102 and the locking hand hole cover 60 can be installed over the hand hole 112 of the pole base 102 in circumstances where the pole portion 104 is mounted at a later time or date than the modular pole base 102. As described above, the locking hand hole cover 60 and security cap 210 can inhibit of prevent unauthorized access to the wiring within the pole base 102.

The method can include determining a desired and/or required height for the light pole. In some embodiments, the pole portion 104 is purchased from a metal supplier near the installation site. In some cases, the pole portion 104 is provided by the same supplier as the pole base 102.

In some embodiments, the pole portion 104 is connected to the upper end of the modular pole base 102 (after the security cap 210 is removed, if the cap 210 was added). The pole portion 104 can be connected to the modular base 102 via use of one or more wedge bolts 114, as described above.

The fitter 106 can be connected to an upper end of the pole portion 104. The fitter 106 can be secured to the upper end of the pole portion 104 using the cap wedge members 194, as described above.

Breakaway Box Bolt

As described above, one or more fasteners can be used to connect one or more of the components of the repair assembly 10 and/or of the modular pole assembly 100 to each other. For example, one or more fasteners can be inserted through the apertures 42 of the reinforcement sleeve 22 of the repair assembly 10 to connect the sleeve 22 to the pole portion 16 of the existing pole (see, e.g., FIG. 1). In some cases, it is desirable to utilize so-called "blind bolts" which do not require manual input on the back side (e.g., the side in the pole portion 16) of the connector to tighten/lock the connector.

Figure 27:
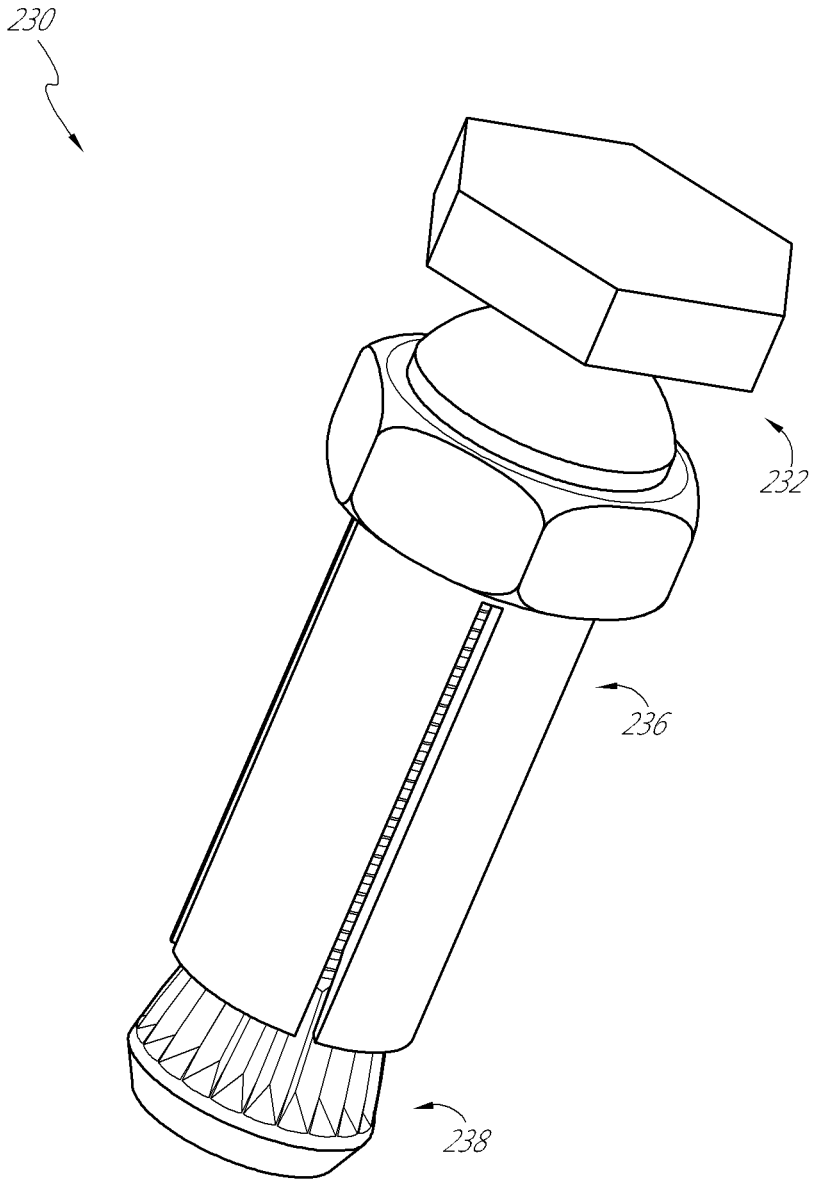
FIG. 27 is a perspective view of a blind bolt.
Figure 29:
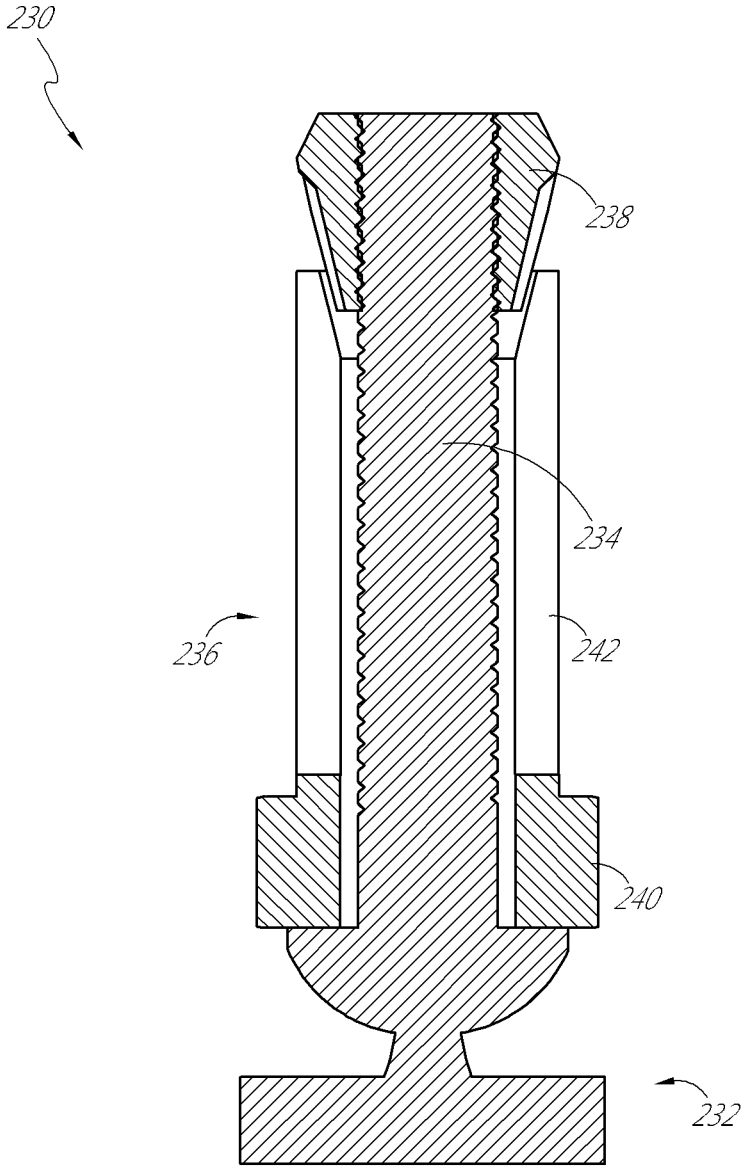
FIG. 29 is a cross-sectional view of the blind bolt of FIG. 27 along the cut plane D-D of FIG. 28.

FIG. 27 illustrates an embodiment of a blind bolt 230. The blind bolt 230 can include a bolt head 232. In some embodiments, the bolt head 232 is connected to a bolt shaft 234 (FIG. 29). An expansion member 236 can be positioned on/around the bolt shaft 234. As illustrated, the blind bolt 230 can include an actuating member 238 connected to the bolt shaft 234.

Figure 28:
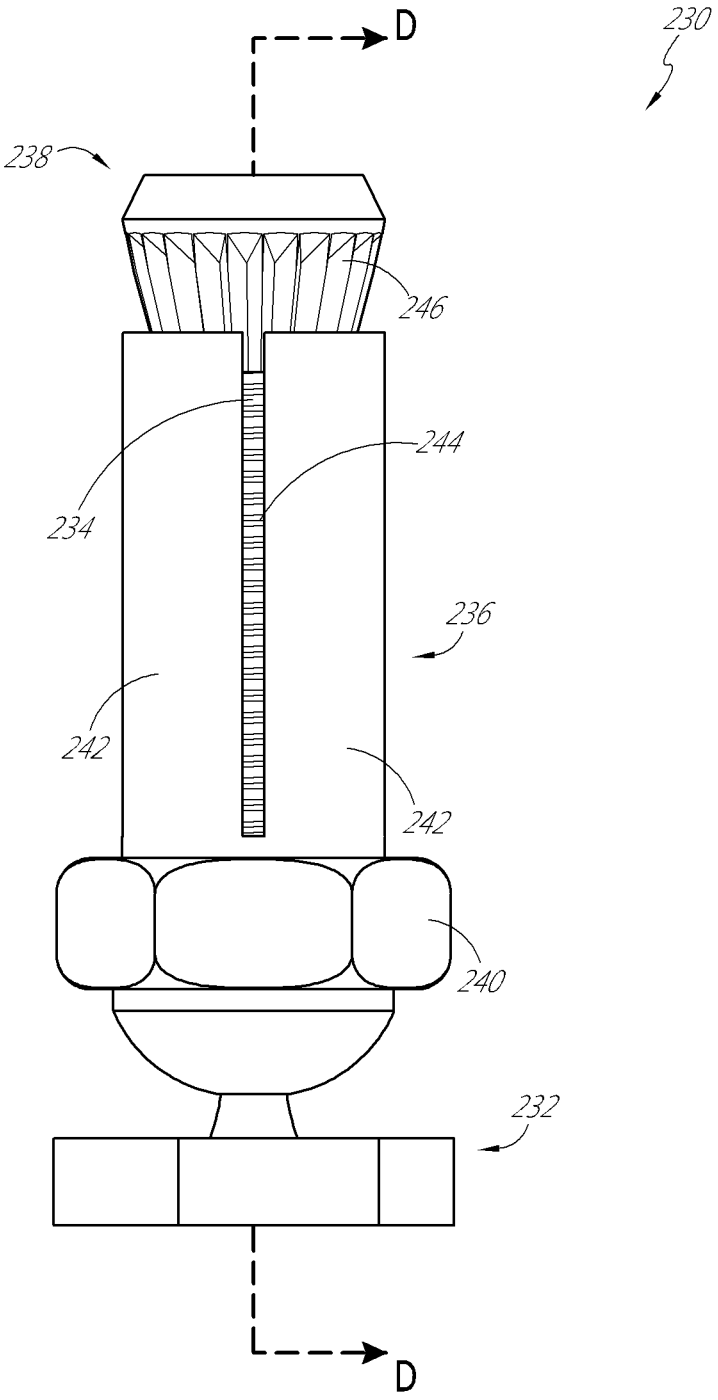
FIG. 28 is a side plan view of the blind bolt of FIG. 27.
Figure 30:
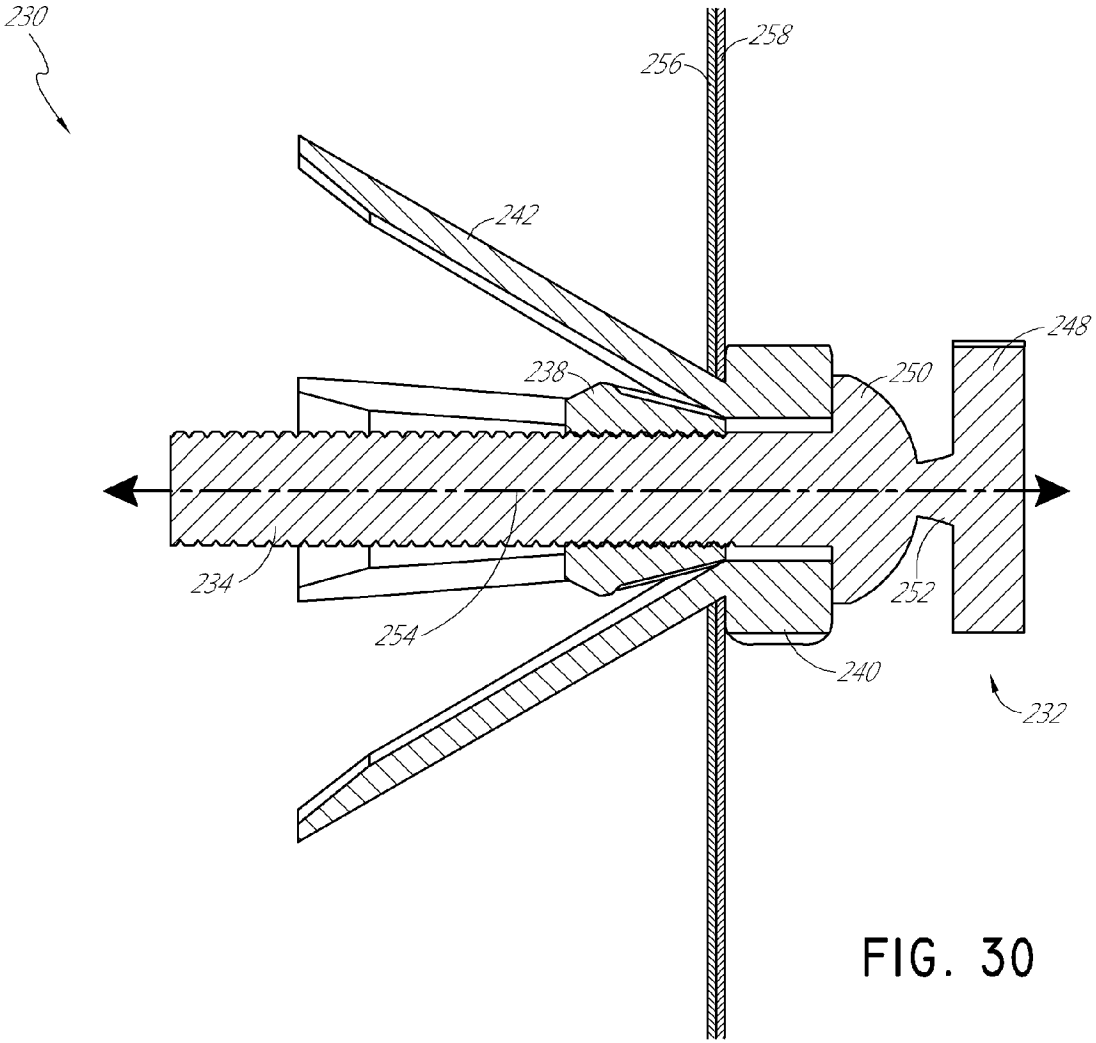
FIG. 30 is a cross-sectional view of the blind bolt of FIG. 27 in an expanded configuration.

As illustrated in FIGS. 28-30, the expansion member 236 can include an input portion 240. The input portion 240 can be configured to receive user input via one or more tools and/or the user's hand. For example, the input portion 240 can have a polygonal (e.g., hexagonal) shape configured to engage with a wrench or other tool.

The expansion member 236 can include a plurality of fingers 242 extending from the user input portion 240 away from the bolt head 232. The fingers 242 can be constructed from a metal or other rigid or semi-rigid material. In some embodiments, the fingers 242 comprise cantilevered portions formed by cutting longitudinal slits 244 in a cylindrical sleeve.

The actuating member 238 can have internal threading configured to couple with the external threading of the bolt shaft 234 (see, e.g., FIG. 29). In some embodiments, the actuating member 238 includes one or more surface features configured to rotationally interfere with a portion of the expansion member 236. For example, the actuating member 238 can include one or more ridges or channels 246 configured to interact with the fingers 242 of the expansion member 238. Interaction between the fingers 242 and the ridges 246 can inhibit or prevent rotation of the actuating member 238 with respect to the actuating member 238.

As illustrated in FIG. 30, the bolt head 232 can have a same or similar configuration as that of the head portion 154 of the elongate members 152 of FIG. 17. For example, the bolt head 232 can include a user input portion 248 (e.g., a hex head) connected to a tamper resistant portion 250 via a neck 252. The neck 252 can be configured to break away from the tamper resistant portion 250 upon application of a threshold torque upon the user input portion 248.

In some embodiments, a user can rotationally fix the user input portion 240 of the expansion member 236 using a tool or other method, while rotating the user input portion 248 of the bolt head 232. In some such circumstances, the ridges 246 of the actuating member 238 fix the actuating member 238 rotationally with respect to the input portion 240 of the expansion member 236 while the threaded engagement between the actuating member 238 and the bolt shaft 234 can draw the actuating member 238 toward the bolt head 232. Movement of the actuating member 238 toward the bolt head 232 can wedge the fingers 242 outward with respect to a longitudinal axis 254 of the bolt shaft 234. Wedging of the finger 242 away from the longitudinal axis 254 of the bolt shaft 234 can secure the blind bolt 230 to a wall (e.g., to an inner wall 256 and outer wall 258). In some embodiments, wedging of the fingers 242 away from the longitudinal axis 254 of the bolt shaft 234 can connect the inner wall 256 to the outer wall 258, as illustrated in FIG. 30.

Pole Base Cover

In some cases, it may be desirable to enhance the aesthetic appeal of a pole base portion. For example, it may be desirable to modify the appearance of a light pole such that it appears that all or most of the pole is constructed from a single piece. In some cases, it may be desirable to hide the hand hole cover 60 and other base components from public view.

Figure 31:
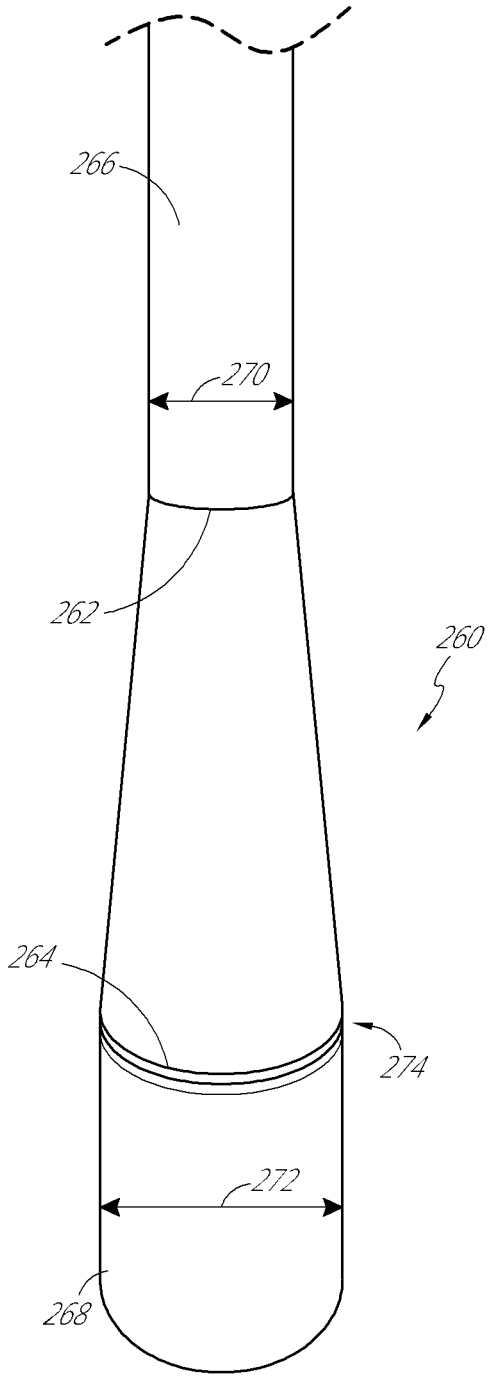
FIG. 31 is a perspective view of a base cover installed on a pole.
Figure 32:
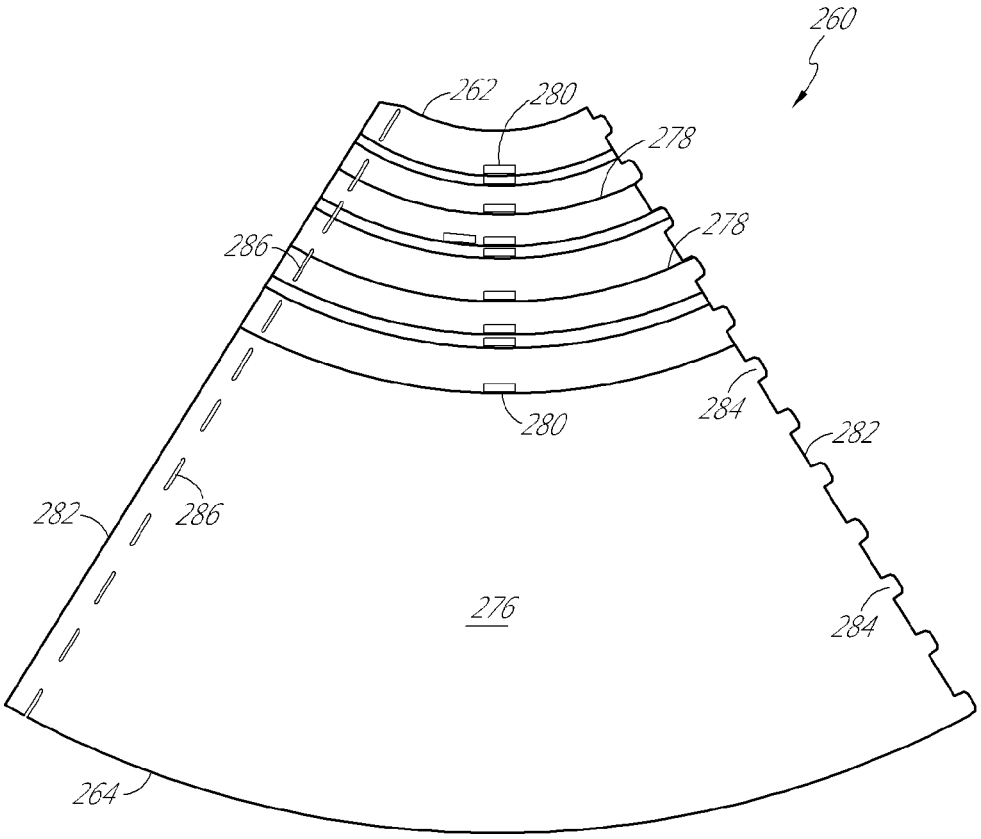
FIG. 32 is a top plan view of the base cover of FIG. 31 in a flattened configuration.

FIGS. 31 and 32 illustrate embodiments of a pole base cover 260. The cover 260 can have an upper end 262 and a lower end 264. The upper end 262 can be configured to connect to, surround, seal against, and/or contact a pole portion 266 of a light pole. In some embodiments, the lower end 264 of the cover 260 can be configured to connect to, surround, seal against, and/or contact an anchor portion 268 of a light pole. For example, the upper end 262 can have a cross-sectional size (e.g., diameter) fit to match a diameter or cross-sectional size 270 of the pole portion 266. In some embodiments, the lower end 264 of the cover 260 has a cross-sectional size (e.g., diameter) fit to match a diameter or cross-sectional size 272 of the anchor portion 268. In some embodiments, a base plate 274 of the light pole remains visible when the cover 260 is installed. In some cases, the lower end 264 of the cover hides the base plate 274 from observation.

As illustrated in FIG. 32, the cover 260 can be manufactured from a flat (e.g., planar) piece of material (e.g., ABS plastic or other polymers). In some embodiments the cover 260 has an inside surface 276 including one or more size markings 278. The size markings 278 can be labelled with size labels 280. The markings 278 and labels 280 can correspond to pre-set pole sizes and/or anchor sizes. For example, a particular marking 278 may be labeled with a measurement such as 6 inch diameter. In such a case, an installer would cut the cover 260 along the marking 278 indicating 6 inch diameter when installing the upper end 262 of the cover 260 onto a 6 inch diameter pole. Some of the markings 278 can correspond to measurements for anchor portion sizes. In some cases, the measurements correspond to square widths, or other polygonal measurements for pole portions 266 and/or anchor portions 268. As such, an installer could maintain an inventory of a single, standard, flat-packed cover 260 which can be customized quickly for a given light pole.

In some embodiments, the cover 260 can be transitioned from the flat configuration of FIG. 32 to the generally frustoconical configuration of FIG. 31. The cover 260 can include one or more mating features on lateral sides 282 of the cover 260. For example, the lateral sides 282 can include one or more tabs 284. The tabs 284 can be inserted into one or more slit 286 cut into the lateral side 282 opposite the tabs 284. In some embodiments, each of the lateral sides 282 includes one or more tabs 284 and one or more slits 286. The tabs 284 can include protrusions (not shown) or other slit-engaging features configured to inhibit or prevent inadvertent decoupling of the tabs 284 from the slits 286 after the tabs 284 are inserted into the slits 286. In some embodiments, the slit-engaging features are tabs, protrusions, or other features punched or cut from the cover 260. In some embodiments, an adhesive (e.g., ABS glue) or other attachment structure/material is used in addition to or instead of the tabs and slits to connect one side 282 of the cover 260 to the other side 282.

In some embodiments, tape, flashing, or some other structure can be applied to the upper and/or lower ends 262, 264 of the cover 260 upon installation of the cover 260 on a light pole. For example, a tape (e.g., aluminum tape) can be applied at the interface between the upper end 262 of the cover 260 and the pole portion 266. The tape can be configured to reduce the likelihood of moisture ingress into the cover 260.

The cover 260 can be painted or otherwise visually modified to match the color and/or texture of the light pole onto which the cover 260 is installed. For example, an installer can paint the cover 260 (and, in some cases, the tape) and light pole after installing the cover 260 on the light pole. Painting or otherwise modifying the appearance of the cover 260 and/or light pole can create an impression that the cover 260 and light pole form a single piece.

While the preferred embodiments of the present disclosure have been described above, it should be understood that they have been presented by way of example only, and not of limitation. It will be apparent to persons skilled in the relevant art that various changes in form and detail can be made therein without departing from the spirit and scope of the disclosure. Thus the present disclosure should not be limited by the above-described exemplary embodiments, but should be defined only in accordance with the following claims and their equivalents. Furthermore, while certain advantages of the disclosure have been described herein, it is to be understood that not necessarily all such advantages may be achieved in accordance with any particular embodiment of the disclosure. Thus, for example, those skilled in the art will recognize that the embodiments of the disclosure may be embodied or carried out in a manner that achieves or optimizes one advantage or group of advantages as taught herein without necessarily achieving other advantages as may be taught or suggested herein.

It will also be apparent to one of skill in the art that some or all of the above-described devices, systems, and methods can be used with or independent of the other devices, systems, and methods described. For example, the locking hand hole cover 60 can be used in combination with any pole or pole base portion having a hand hole, including the poles and pole base portions described above. Additionally, the blind bolts 230 can be used to secure any two walls together. The cover 260 can also be used in combination with any of the assemblies described above, and/or with other light poles and other pole installations.

What is claimed is:

1. A light pole repair assembly for repairing or reinforcing a light pole, the repair assembly comprising:

a reinforcement member comprising:

a reinforcement base having a slot configured to receive at least a portion of the light pole, the reinforcement base including a plurality of apertures configured to receive one or more fasteners; and a reinforcement sleeve having a first sidewall connected to the reinforcement base and extending upward from the reinforcement base, a second sidewall connected to and extending upward from the reinforcement base and connected to the first sidewall, and a third sidewall connected to and extending upward from the reinforcement base and connected to the first sidewall;

wherein the first, second, and third sidewalls of the reinforcement sleeve are positioned on three sides of a pole portion of a light pole when the slot of the reinforcement base receives at least a portion of a light pole, and wherein the reinforcement sleeve is affixed to a pole portion of a light pole when the slot of the reinforcement base receives at least a portion of a light pole.

2. The system of claim 1, wherein first, second, and third sidewalls of the reinforcement sleeve extend below and above a hand hole of a light pole when the slot of the reinforcement base receives at least a portion of a light pole.

3. The system of claim 1, wherein the reinforcement base has a generally square perimeter.

4. The system of claim 1, wherein the reinforcement base has a generally circular shape.

5. The system of claim 1, comprising a plurality of spacers connected to the reinforcement base and to anchor bolts extending upward from a base of the light pole when the slot of the reinforcement base receives at least a portion of the light pole, the plurality of spacers positioned between the reinforcement base and the base of the light pole and configured to space the reinforcement base above the base of the light pole.

6. The system of claim 5, comprising a plurality of all-thread bolts inserted through a plurality of apertures in the reinforcement base and threadedly engaged with at least a portion of the each of the plurality of spacers.

7. A hand hole cover for a light pole hand hole, the hand hole cover comprising:

a cover frame having a perimeter sized and shaped to surround the hand hole, a back side configured to abut an outer wall of a light pole, a front side spaced from the outer wall of the light pole, a wall extending between the front side and the back side, and a cover aperture extending through the wall and configured to receive a body of a lock;

a mating plate having a front side and a back side, the mating plate positioned between the front side and the back side of the cover frame within the perimeter of the cover frame, the mating plate connected to the cover frame and comprising a loop aperture, a first lock aperture, and a second lock aperture;

a backing bar configured to fit within a light pole, the backing bar having a first end, a second end, and a length between the first end and the second end, the length of the backing bar being greater than a height of the hand hole and greater than a width of the hand hole;

a first fastener configured to pass through the first lock aperture, configured to connect to the backing bar at a first position along the length of the backing bar, and configured to draw the backing bar toward the mating plate in response to user input;

a second fastener configured to pass through the second lock aperture, configured to connect to the backing bar at a second position along the length of the backing bar, and configured to draw the backing bar toward the mating plate in response to user input; and a cover plate having a front surface, a back surface, and a lock loop extending from the back surface of the cover plate, the lock loop configured to fit through the loop aperture from the front side of the mating plate, the lock loop configured to receive a shank of a lock;

wherein the backing bar is configured to secure the cover frame against the outer wall of a light pole when the fastener is tightened to draw the backing bar toward the mating plate when the backing bar is positioned within a light pole; and wherein the cover plate is configured to inhibit access to the lock loop and mating plate when the lock loop is inserted through the loop aperture, the lock shank is inserted through the lock loop, a lock is in a locked configuration, and the cover frame is secured against the outer wall of a light pole.

8. The cover of claim 7, wherein the first and second fasteners are bolts.

9. The cover of claim 7, wherein the backing bar comprises a center portion having a first height as measured perpendicular to the length of the backing bar toward the mating plate, a first outer portion between the first end of the backing bar and the center portion and having a second height as measured perpendicular to the length of the backing bar toward the mating plate, and wherein the second height is less than the first height.

10. The cover of claim 7, wherein the mating plate comprises one or more viewing apertures configured to permit a user to view a position of the backing bar during installation of the hand hold cover.

11. The cover of claim 7, wherein the back side of the cover frame is planar when the hand hole cover is installed on a light pole having a rectangular cross-section.

12. The cover of claim 7, wherein the back side of the cover frame has a concave shape when the hand hole cover is installed on a light pole having a circular or oval-shaped cross-section.

13. A modular light pole assembly comprising:

a pole base having:

a pole base plate having a plurality of apertures configured to receive one or more fasteners; and a hollow pole base sleeve connected to and extending upward from the pole base plate, pole base sleeve having a cross-sectional shape parallel to the pole base plate and at least one sidewall with an inner surface and an outer surface and a hand hole through the at least one sidewall; and at least one wedge bolt configured to fit at least partially within a space between the inner surface of the at least one sidewall of the pole base sleeve and an outer surface of a hollow pole having a cross-sectional shape different from the cross-sectional shape of the hollow pole base sleeve, the at least one wedge bolt comprising:

a wedge sleeve assembly having first end, a second end, and a length extending between the first end and the second end, wedge sleeve assembly having a plurality of wedge portions unconnected to each other wedge portion, each of the plurality of wedge portions have an internal channel through at least a portion of a length of each wedge portion; and an elongate member configured to extend through at least a portion of each of the internal channels of the plurality of wedge portions, the elongate member configured to receive user input to shorten the length of the wedge sleeve;

wherein at least two of the wedge portions have contact ends that are configured to contact each other when the length of the wedge sleeve is shortened, each of the contact ends lying on parallel planes, the parallel planes of the contact ends being offset from the length of the wedge sleeve by a first angle greater than 0° and less than 90°;

wherein, when the length of the wedge sleeve is shortened, the at least one of the wedge portions is configured move in a direction lateral to the length of the wedge sleeve to mate a hollow pole to the hollow pole base sleeve.

14. The modular light pole assembly of claim 13, wherein the cross-sectional shape of the hollow pole base sleeve is generally rectangular, and wherein the at least one wedge bolt is configured to fit at least partially within a space between the inner surface of the at least one sidewall and a hollow pole having a round cross-sectional shape.

15. The modular light pole assembly of claim 13, further comprising a cap, the cap having:

a hollow mating portion having a first cross-sectional shape and a longitudinal axis;

a collar portion connected to the mating portion and having a second cross-sectional shape;

a hollow coupling portion connected to the collar portion and extending away from the mating portion, the hollow coupling portion having a third cross-sectional shape; and at least one wedge member, each wedge member comprising:

a first portion connected to at least one of the collar portion and the hollow mating portion, the first portion having a first end, a second end between the first end and the collar portion, and a first connector channel extending through the first and second ends of the first portion, the first end of the first portion having a first sloped surface lying on a plane offset from the longitudinal axis of the hollow mating portion by an angle greater than 0° and less than 90°;

a second portion having a first end, a second end between the first end and the first end of the first portion, and a second connector channel extending through the first and second ends of the second portion, the second end of the second portion having a second sloped surface lying on a plane parallel to the plane of the first sloped surface of the first end of the first portion; and an extended member extending through the first and second ends of the first portion and the second end of the second portion, the extended member configured to receive user input to move the second portion toward the first portion;

wherein the second portion of each wedge member is configured to move laterally outward with respect to the longitudinal axis of the hollow mating portion when the second portion is moved toward the first portion of each wedge member.

16. The modular light pole assembly of claim 13, wherein the hollow pole base sleeve includes one or more internal flanges configured to limit downward movement of a hollow pole within the hollow pole base sleeve.

17. The modular light pole assembly of claim 13, comprising a security cap having:

a cap portion; and a coupling portion connected to the cap portion and extending downward from the cap portion;

wherein the hollow pole base sleeve includes one or more internal flanges, wherein the coupling portion is configured to releasably connect to one or more of the one or more internal flanges; and wherein the cap portion is sized and shaped to inhibit or prevent access to an interior of the hollow pole base from a top end of the hollow poll base past the cap portion.

18. The module light pole assembly of claim 17, wherein the coupling portion includes a bolt extender connected to and extending downward from the cap portion, and a bolt connected to and extending downward from the bolt extender.

* * * * *